US005463691A

United States Patent [19]

Nakae et al.

[11] Patent Number: 5,463,691

[45] Date of Patent: Oct. 31, 1995

[54] EFFECT IMPARTING APPARATUS HAVING STORAGE UNITS FOR STORING PROGRAMS CORRESPONDING TO FORM AND EFFECT TO BE IMPARTED TO AN INPUT SIGNAL AND FOR STORING OUTPUT FORM PROGRAMS TO DETERMINE FORM OF OUTPUT SIGNAL WITH IMPARTED EFFECT

[75] Inventors: Tetsiochi Nakae, Ome; Kunihiro Matsubara, Tokyo, both of Japan

[73] Assignee: Casio Computer Co., Ltd., Tokyo, Japan

[21] Appl. No.: 132,139

[22] Filed: Oct. 4, 1993

[30] Foreign Application Priority Data

| | | | |
|---|---|---|---|
| Oct. 11, 1992 | [JP] | Japan | 4-297912 |
| Dec. 15, 1992 | [JP] | Japan | 4-354145 |
| Dec. 15, 1992 | [JP] | Japan | 4-354146 |

[51] Int. Cl.[6] ..... G10H 1/043

[52] U.S. Cl. ..... 381/61; 381/62

[58] Field of Search ..... 381/61–63; 84/625–626, 84/630, 629, 631, 622, 664

[56] References Cited

U.S. PATENT DOCUMENTS

| | | | |
|---|---|---|---|
| 4,628,789 | 12/1986 | Fujimori | 381/62 |
| 4,864,625 | 9/1989 | Hanzawa et al. | 381/61 |
| 5,050,216 | 9/1991 | Hanzawa et al. | 381/62 |
| 5,073,942 | 12/1991 | Yoshida et al. | 381/61 |
| 5,218,710 | 6/1993 | Yamaki et al. | 381/61 |
| 5,272,274 | 12/1993 | Kimura | 381/63 |

*Primary Examiner*—Stephen Brinich

*Attorney, Agent, or Firm*—Frishauf, Holtz, Goodman, Langer & Chick

[57] ABSTRACT

The kinds of effects imparted to signals received from a keyboard or a microphone are stored beforehand in a first and a second effector. An effect (1) input selector and an effect (2) input selector set forms in which signals are fed to the respective effectors. A direct tone control switch, and effect (1) and (2) L/R switches set a form in which the signal with an imparted effect is output. The input forms of those signals, the kinds of effects and the output form of the signals with an imparted effect are displayed on a list display. The user operates a ten-key unit to select a desired input and output forms of the signals and the kinds of effects to be imparted to the signal while viewing the list display.

20 Claims, 24 Drawing Sheets

FIG.2

| ★ EFFECT BANK LIST |
|---|
| ✳ : Effective Melody Only, |
| K : Effective Keyboard Only, |
| M : Effective Mic Only |
| V : Vocoder Mode |

| Single-REVERB/PITCH |
|---|
| 00 Small Hall |
| 01 Large Hall |
| 02 Stadium |
| 03 Live House |
| 04 Metalic Room |
| 05 ✳Delay |
| 06 ✳Stereo Delay |
| 07M✳Pitch Sifter |
| 08 ✳Harmonizer |
| 09 ✳Ensemble |

FIG.3

| Single-EFFECTS |
|---|
| 10 ✳Flanger A |
| 11 ✳Flanger B |
| 12 ✳Chorus |
| 13 ✳Distortion |
| 14 ✳Tremolo |
| 15 ✳Vibrato |
| 16 ✳Heavy Vibrato |
| 17 Panning A |
| 18 Panning B |
| 19V✳Vocoder |

FIG.4

| Complex-EFFECTS I | |
|---|---|
| 20 ⁎Distortion | / ⁎Flanger |
| 21 ⁎Distortion | / ⁎Stadium |
| 22 ⁎Chorus | / ⁎Delay |
| 23 Chorus | / ⁎Small Hall |
| 24 ⁎Flanger | / ⁎Delay |
| 25 ⁎Flanger | / ⁎Small Hall |
| 26 Small Hall | / ⁎Vibrato |
| 27 ⁎Vibrato | / ⁎Small Hall |
| 28 ⁎Vibrato | / ⁎Chorus |
| 29 ⁎Vibrato | / ⁎Tremolo |

FIG.5

| Complex-EFFECTS II | |
|---|---|
| 30 ⁎Ensemble | / ⁎Small Hall |
| 31 ⁎Ensemble | / ⁎Delay |
| 32 ⁎Ensemble | / ⁎Flanger |
| 33 ⁎Harmonizer | / ⁎Small Hall |
| 34 ⁎Harmonizer | / ⁎Delay |
| 35 ⁎Tremolo | / ⁎Small Hall |
| 36 ⁎Tremolo | / ⁎Flanger |
| 37 ⁎Delay | / ⁎Flanger |
| 38 Large Hall | / Panning B |
| 38 ⁎Stereo Delay | / ⁎Small Hall |

FIG.6

| Complex-PITCH | |
|---|---|
| 40M*Heavy Vibrato | / *Stereo Delay |
| 41M*Heavy Vibrato | / *Chorus |
| 42M*Rand Vibrato | / Small Hall |
| 43M*Pitch Sifter | / Small Hall |
| 44M*Pitch Sifter | / *Chorus |
| 45 *Pitch Sifter | / *Feedback |
| 46K*Distortion | / *Small Hall |
| 47K*Distortion | / *Delay |
| 48K Transpose | / Chorus |
| 49K Transpose | / Small Hall |

FIG.7

| Complex-OTHERS | |
|---|---|
| 50 *Ensemble | / *Panning |
| 51 *Harmonizer | / *Panning |
| 52 *Heavy Vibrato | / *Panning |
| 53 *Tremolo | / *Panning |
| 54 Small Hall | / Panning |
| 55 *Distortion | / *Panning |
| 56V*Vocoder | / *Small Hall |
| 57V*Vocoder | / *Stereo Delay |
| 58V*Vocoder | / *Flanger |
| 59 NON Effect | |

FIG.9

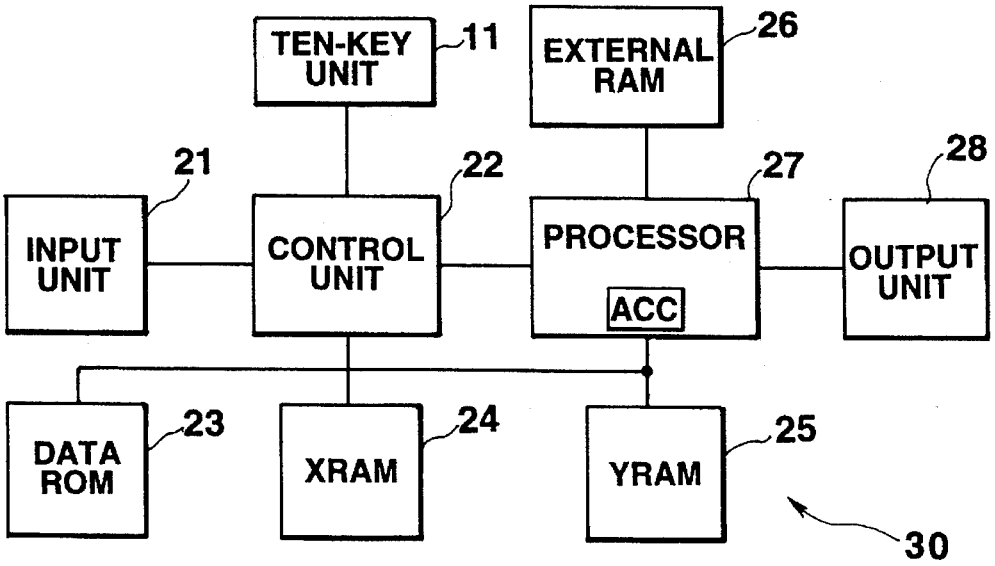

FIG.10

| ADDRESS | | | | |
|---|---|---|---|---|
| 0 | - - - - - - - - | DESTINATION ADDRESS (18~8) | DATA ROM OFFSET (7~0) | EFFECT 1 |
| 1 | XRAM WIDTH (23~16) | XRAM WIDTH (15~8) | EXT.RAM LOOP (7~0) | |
| 2 | YRAM WIDTH (23~16) | YRAM WIDTH (15~8) | FEEDBACK LEVEL (7~0) | |
| 3 | - - - - - - - - | DESTINATION ADDRESS (18~8) | DATA ROM OFFSET (7~0) | EFFECT 2 |
| 4 | YRAM WIDTH (23~16) | XRAM WIDTH (15~8) | EXT. RAM LOOP (7~0) | |
| 5 | XRAM WIDTH (23~16) | XRAM WIDTH (15~8) | - - - - - - - - | |
| 6 | INPUT SETTING ROUTINE ADDRESS 1 | INPUT SETTING ROUTINE ADDRESS 2 | - - - - - - - - | |
| 7 | OUTPUT PRODUCING ROUTINE ADDRESS | DAC OUTPUT PROCESSING ROUTINE ADDRESS | - - - - - - - - | |

FIG.14

XRAM

| | |
|---|---|
| 0<br>219 | EFECTOR WORK AREA |
| 220 | A/D FILTER- POINT VALVE |
| 221<br>222 | SYSTEM WORK AREA |
| 223<br>224 | EFFECT OUTPUT INTERPOLATION L/R STORAGE |
| 225 | FEEDBACK LEVEL |
| 226 | EFFECT CONTROL TYPE FLAG |
| 227 | DIGITAL INPUT FILTER POINT STORAGE |
| 228<br>229 | EFFECT 1 DESTINATION ADDRESS<br>EFFECT 2 DESTINATION ADDRESS |
| 230<br>231 | INPUT SETTING ROUTINE 1 ADDRESS<br>INPUT SETTING ROUTINE 2 ADDRESS |
| 232<br>233 | DAC OUTPUT PROCESSING ADDRESS<br>EFFECT OUTPUT PRODUCING ROUTINE ADDRESS |
| 234<br>235 | AD INPUT VALUE STORAGE<br>DIGITAL INPUT VALUE STORAGE |
| | |
| 237 | TONE ERASURE ENVELOPE VALUE STORAGE |
| 238<br>239<br>240<br>241 | EFFECT 1 LEFT OUTPUT STORAGE<br>EFFECT 1 RIGHT OUTPUT STORAGE<br>EFFECT 2 LEFT OUTPUT STORAGE<br>EFFECT 2 RIGHT OUTPUT STORAGE |
| 242<br>243 | EFFECT DAC OUTPUT LEFT STORAGE<br>EFFECT DAC OUTPUT RIGHT STORAGE |
| 244<br>⋮<br>247 | EFFECT 1 YRAM ADDRESS SAVE |
| 248<br>⋮<br>251 | EFFECT 1 YRAM ADDRESS SAVE |
| 252 | OTHERS |

EFFECT IMPARTING APPARATUS HAVING STORAGE UNITS FOR STORING PROGRAMS CORRESPONDING TO FORM AND EFFECT TO BE IMPARTED TO AN INPUT SIGNAL AND FOR STORING OUTPUT FORM PROGRAMS TO DETERMINE FORM OF OUTPUT SIGNAL WITH IMPARTED EFFECT

BACKGROUND OF THE INVENTION

1. Field of the Invention

The present invention relates to effect imparting apparatus which are capable of imparting effects, which can be hereinafter referred to solely as effects, such as delay or reverberation to signals input thereto.

2. Description of the Related Art

Conventionally, a so-called multi-effector which imparts any one of various effects such as distortion, chorus, delay, reverberation, etc., to a signal received from an electronic musical instrument or the like has been proposed and put to practical use.

Some conventional apparatus had a structure which imparted a single effect to an analog signal input to thereto, using an analog unit such as a BBD or a transistor. Along with a recently developed digital structure of a signal generator, the effect imparting apparatus has a structure which processes an input signal digitally to impart an effect to the input signal.

More recently, in order to provide a higher quality tone, it is desired to provide an imparting apparatus which is capable of imparting a plurality of different effects simultaneously to the input signal, imparting the same effect to, or performing different processes on, two input signals, or allowing the user to select any one of those processes freely.

In the conventional analog effect imparting apparatus, a plurality of units must be re-connected with prodigious labor in order to change the kind of the effect or the form of impartment of such effect.

Recently, the kinds of effects to be imparted have increased, and hence an effect imparting apparatus must be prepared for each of the kinds of the effects, which was virtually impractical.

In order to eliminate the above drawbacks, digital effect imparting apparatus have been developed. In those apparatus, various effects are stored beforehand as programs in a memory, a program corresponding to a selected effect is only required to be read out of the memory as required. Such apparatus is not so large-sized compared to the analog one.

Even with such digital effect imparting apparatus, however, as the kind of effects to be imparted increases as recently and the form of imparting selected effects is diversified; for example, how to impart selected effects to a plurality of input signals and how to output the respective signals with the imparted effects, an independent program must be provided for each of the various effects and the forms of effect impartment, which would greatly increase the quantity of programs to be stored. This would require a large capacity of memory, which would increase the cost and access time, undesirably.

Increases in the number of effects to be selected and forms of effect impartment would increase the number of operators (for example, switches) used to select an effect and/or the form of effect impartment.

SUMMARY OF THE INVENTION

It is therefore an object of the present invention to provide an effect imparting apparatus which is capable of suppressing an increase in the memory capacity and the number of operators, imparting more kinds of effects to an input signal than the conventional apparatus, and selecting the form of effect impartment freely.

According to one aspect of the present invention, there is provided an effect imparting apparatus including:

program storage means for storing a plurality of programs corresponding to a number of effects to be imparted to a signal input to the apparatus;

select means for externally selecting any particular one of the programs stored in said program storage means; and signal processing means for imparting an effect to the input signal on the basis of the program selected by said select means and outputting the resulting signal.

Thus, according to this structure, even when the kinds of effects to be imparted to an input signal or the kinds of the form of effect impartment are changed, the capacity of a memory which stores the programs and the number of operators which select an effect and the form of effect impartment and hence the cost are reduced compared to the conventional structure in which an independent program is provided for each of the various effects and the forms of effect impartment. With the same capacity of memory, more kinds of effects can be imparted to the input signal, and more kinds of forms of effect impartment can be selected freely.

It is another object of the present invention to provide an effect imparting apparatus which is capable of suppressing an increase in the memory capacity and the number of operators, imparting more kinds of effects to a plurality of input signals than the conventional apparatus, and selecting the form of effect impartment freely.

According to another aspect of the present invention, there is provided an effect imparting apparatus including:

input form program storage means for storing a program corresponding to the form of imparting an effect to a respective one of a plurality of signals input to said apparatus;

effect program storage means for storing a program corresponding to a respective one of a plurality of effects imparted to the input plurality of signals;

output form program storage means for storing an output form program for determining a form in which the signal with an imparted effect is output;

select means for externally selecting a desired input form program, effect program and output program from the input form program storage means, effect program storage means, and output form program storage means, respectively; and signal processing means for imparting an effect to the input plurality of signals on the basis of the input form program, effect program and output form program selected by the select means.

According to this structure, no independent program is required to be provided for each of various kinds of effects, and the forms of effect impartment. By storing in the data memory various data for selection of the respective kinds of effects and forms of effect impartment and causing the selection means to designate a new effect to be imparted, required data is read out of the data memory and set in the work memory, and subroutines called with the required data are combined to compose one program, in which the input signal is processed. Thus, even when the kind of an effect to be imparted to the input signal and the kind of form of effect impartment are changed, the capacity of the memory which stores the programs and the cost are reduced compared to the conventional apparatus in which the memories store corresponding independent programs.

Even if the number of effects to be selected and the number of forms of effect impartment increase due to the use of the ten-key unit and select keys, the number of operators which select an effect to be imparted and the form of effect impartment is reduced. According to the present invention, when the memory has the same capacity as that used in the conventional apparatus, more kinds of effects can be imparted to the input signal than in the conventional apparatus. In addition, more forms of effect impartment can selected freely.

It is still another object of the present invention to provide an effect imparting apparatus which is capable of selecting in an easier manner a desired one from among more kinds of effects than those provided by the conventional apparatus, and imparting the selected effect to the input signal.

According to another aspect of the present invention, there is provided an effect imparting apparatus including within the apparatus body:

program storage means for storing a plurality of programs corresponding to a number of effects to be imparted to a signal input to the apparatus;

select means for selecting a desired one of the programs stored in said program storage means;

signal processing means for imparting and outputting an effect to the input signal on the basis of the program selected by the select means and outputting the resulting signal;

operation means provided on an outer surface of the apparatus for externally controlling the selection by the select means; and display panel means provided on the outer surface of the apparatus and describing a program stored in the program storage means.

According to this structure, a desired effect is selected from among more kinds of effects than those provided by the conventional apparatus and imparted to the input signal. Since the selectable effects are described on the display panel, it is clearly recognized which kind of effect is selectable.

BRIEF DESCRIPTION OF THE DRAWINGS

Other objects and features of the present invention will be easily understood by those skilled in the art from the following detailed description of preferred embodiments of the present invention in conjunction with the accompanying drawings.

In the drawings:

FIGS. 2–7 show the displayed contents of a list display on the electronic musical instrument of FIG. 1.

FIG. 9 is a block diagram of an effect imparting apparatus attached to the musical instrument of the embodiment.

FIG. 10 specifically shows an illustrative disposition of header data and parameters stored in a data ROM of the embodiment.

FIG. 14 shows a work area, a data storage area, etc., of an XRAM in correspondence to addresses in the embodiment.

DETAILED DESCRIPTION OF THE PREFERRED EMBODIMENTS

Embodiments of the present invention will be below described with respect to the drawings.

A. FIRST EMBODIMENT

Figure 1:
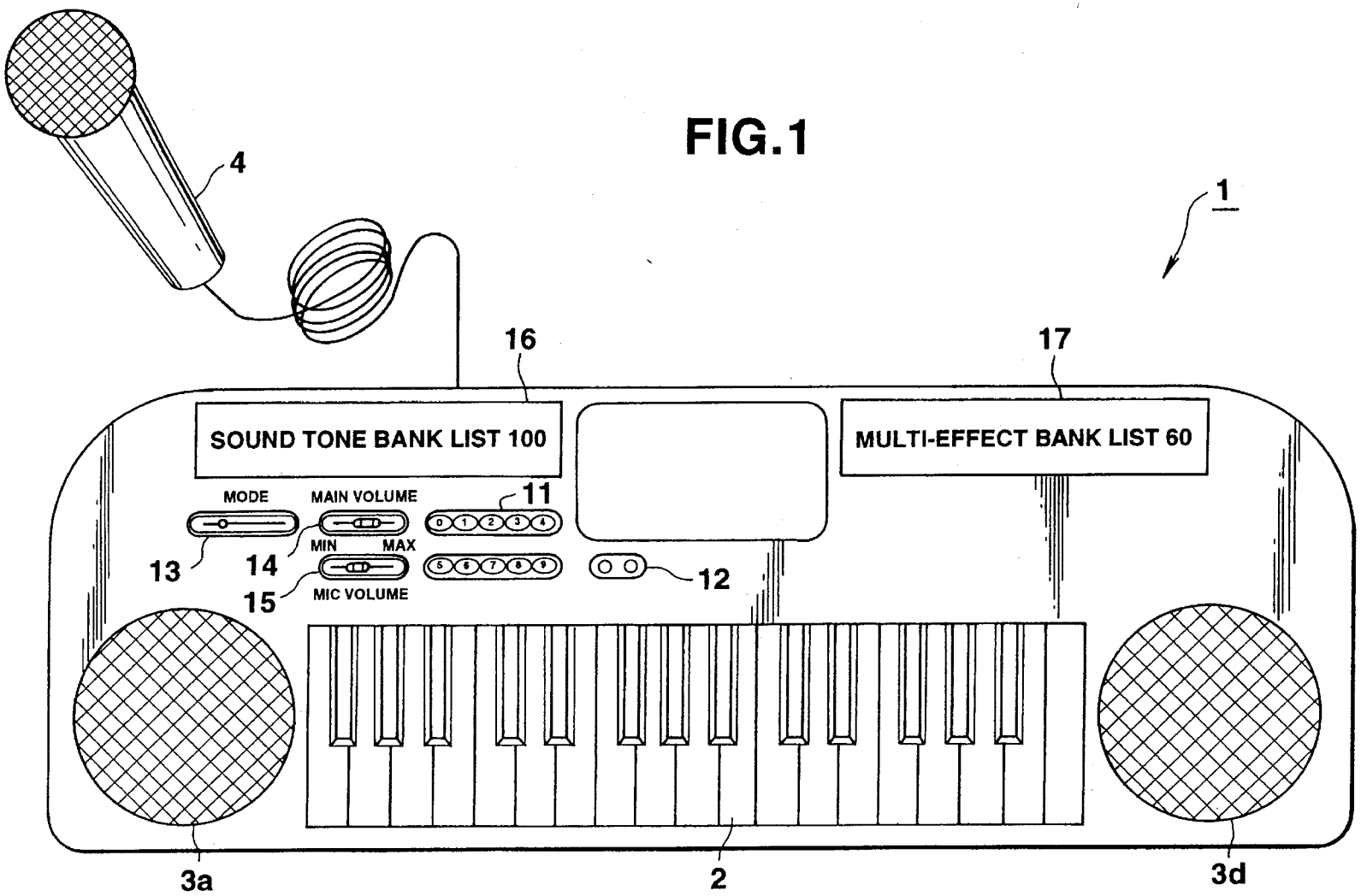
FIG. 1 shows the appearance of an electronic musical instrument as a first embodiment of the present invention.

FIG. 1 shows the appearance of a first embodiment of an electronic musical instrument with an effect imparting apparatus (digital effector) according to the present invention. In the first embodiment, the kinds of effects to be imparted to a plurality of input signals and the kinds of forms of such effect impartment are changed illustratively by the designation of any one key of a ten-key unit.

In FIG. 1, reference numeral 1 denotes an electronic musical instrument proper which is provided with a keyboard 2; speakers 3*a*, 3*b*; a microphone 4; a ten-key unit 11 which selects one of a plurality of timbres effects, using a corresponding number of double figures; a changeover switch 12 which changes over a selected key of the ten-key unit 11 to a timbre or effect; a power supply switch 13; a keyboard volume 14; and a microphone volume 15 on a front thereof.

When a left-hand button in FIG. 1 is depressed, the changeover switch 12 switches the ten-key unit 11 to a timbre (TONE BANK) side. When a right-hand button in FIG. 1 is depressed, the changeover switch 12 switches the ten-key unit 11 to an effect (EFFECT BANK) side. The power supply switch 13 is capable of turning on/off a power supply for the electronic musical instrument proper 1 and selecting any one of modes "AUDIO", "RECORDED ORCHESTRAL ACCOMPANIMENT", and "GUIDE". The keyboard volume 14 adjusts the level of a musical tone signal output in correspondence to a key code designated at the keyboard 2. The microphone volume 15 adjusts the output level of the microphone 4.

The electronic musical instrument proper 1 is also provided with a timbre name No. list display 16 and an effect name No. list display 17 on the front thereof. The timbre name No. list display 16 has displayed (in this case, has printed) 100 kinds of designatable timbres "00"–"99" in the form of a list. The effect name No. list display 17 has displayed (in this case, has printed) 60 kinds of designatable effects "00"–"59" in the form of a list, as illustrated more particularly in FIGS. 2–7.

In each of FIGS. 2–7, the sign "*" points out an effect imparted to a particular timbre alone; K points out an effect imparted to an output of the keyboard 2 alone; M points out an effect imparted to the output of the microphone 4 alone; and V points out a mode in which the vocoder is selected. The vocoder imparts an effect which changes the spectrum of a musical tone signal from the keyboard 2, for example, depending on a voice output from the microphone 4.

Figure 8:
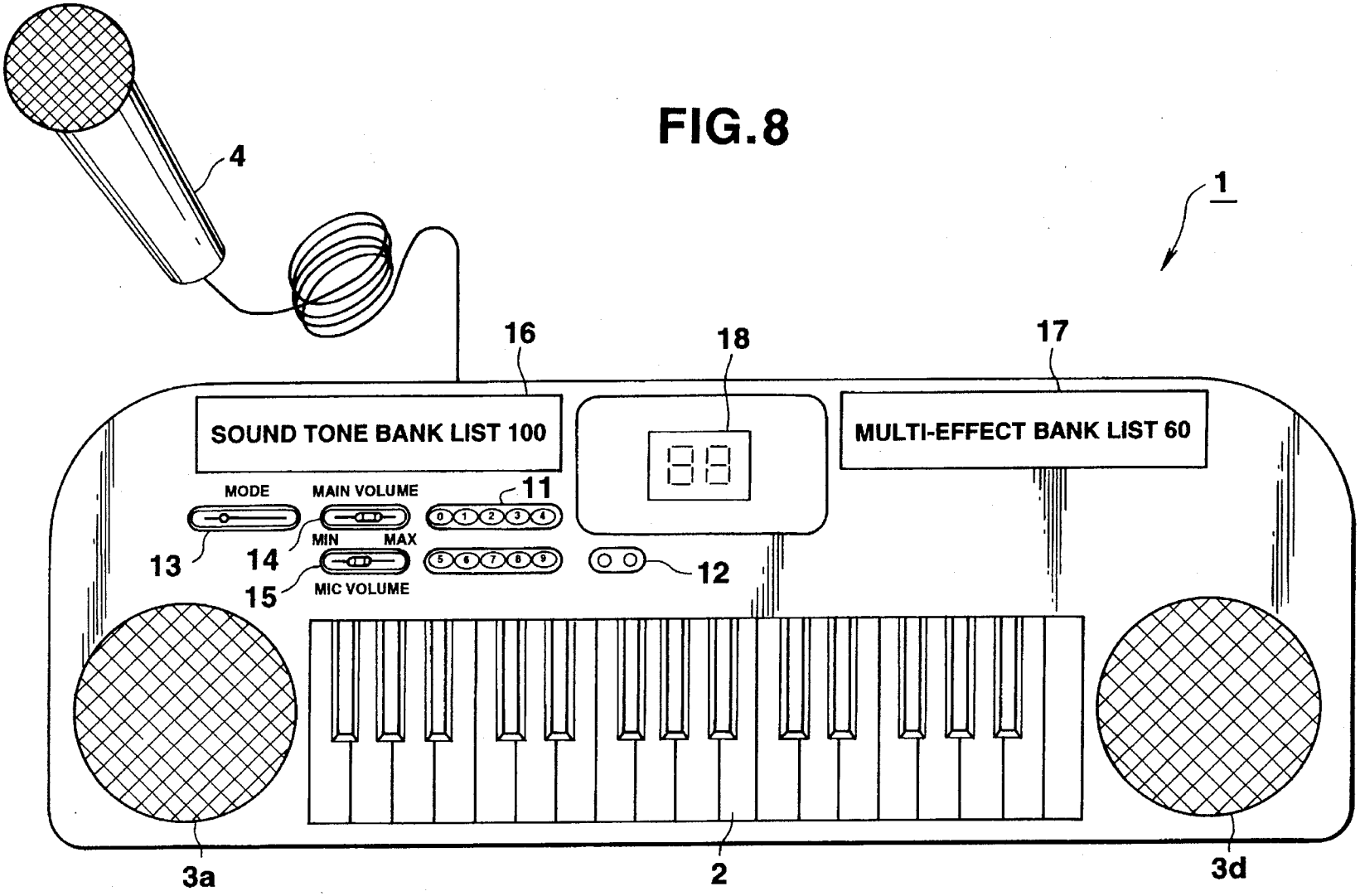
FIG. 8 shows the appearance of a modification of the electronic musical instrument of the embodiment.

FIG. 8 shows the appearance of the electronic musical instrument proper 1 with a liquid crystal display 18 which displays a numeral of double figures designated by the ten-key unit 11. The ten-key unit 11 is capable of selecting a timbre and an effect by designating a timbre No. and an effect No. with double figures, but the designated Nos. cannot be viewed in the example of FIG. 1. In order to eliminate this problem, the structure of FIG. 8 allows a numeral of double figures designated by the ten-key unit 11 be easily ascertained on the liquid crystal display 18, advantageously.

FIG. 9 is a block diagram of an effect imparting apparatus provided to the electronic musical instrument 1 of FIG. 1. In FIG. 9, the effect imparting apparatus is provided with a ten-key unit 11, input unit 21, control unit 22, data ROM 23, XRAM 24, YRAM 25, external RAM 26, processor 27 and output unit 28.

The ten-key unit 11 has the function of selecting a timbre and the function of designating an effect No. from among a plurality of predetermined effects by depressing keys corresponding to a numeral of double figures. The signal from the ten-key unit 11 is input to the control unit 2. The input unit 21 is used to input a plurality of voice signals to the apparatus. The present apparatus receives a digital musical tone signal from the keyboard 2 and an analog signal from the microphone 4 (FIG. 9), and is provided with an analog signal input circuit composed of an analog filter and an analog-to-digital (AD) converter, and a digital waveform input circuit. A digital musical tone signal from the keyboard 2 is received by the digital waveform data input circuit while an analog musical tone signal from the microphone 4 is received by the analog signal input circuit.

The control unit 22 reads out an effect No. designated by the ten-key unit 11 and reads corresponding header data out of the data ROM 23 and controls the input unit 21 and the output unit 28, and addresses and data in the XRAM 24 and YRAM 25. The data ROM 23 stores parameters and header data corresponding to a plurality of effects and forms of effect impartment. That is, it beforehand stores an input form program corresponding to the form of effect impartment to the two respective input signals, an effect program corresponding to each of a plurality of effects to be imparted to the two input signals, and an output form program which determines a form in which a musical tone signal with an effect imparted should be output. Thus, the data ROM 23 has the function of program storage means and more particularly, corresponds to the functions of input form program storage means, effect program storage means and output form program storage means.

FIG. 10 specifically shows header data and parameters stored in the data ROM 23. In FIG. 10, the leftmost numeral shows an address in the ROM. The bracketed numerals show an address in a work area in 8 bits. For example, the "effect 1" is composed of 8 bits ×8 areas in 3 rows from among which areas a destination address, a data ROM OFFSET, . . . are designated to thereby ensure data required for realize the "effect 1". This applies to the "effect 2". The "effect 1" and "effect 2" are disposed so as to impart, for example, a reservation and a delay, respectively, and designated in double figures by the ten-key unit 11. In FIG. 10, only the "effect 1" and "effect 2" are shown, but all 60 kinds of effects are provided by required stored data.

The XRAM 24 and YRAM 25 have the function of a so-called work RAM used for an operation for effect impartment, storage of routine addresses for input/output control, a temporary stock of input/output data, etc. The external RAM 26 is used as a so-called work area when the processor 27 performs signal processing (for example, signal delay, using the RAM 26 as a delay RAM) for effect impartment. The processor 27 is provided with a multiplier, an adder and an accumulator (ACC) to thereby perform an operation for effect impartment actually. The accumulator serves a main role in data processing and stores data and the result of calculations. The output unit 28 is provided with a digital-to-analog (DA) converter, an analog filter, an output amplifier and speakers to convert digital data output from the processor 27 to an analog signal, amplifies the analog signal with the amplifier and causes the resulting signal to go out through the speakers 3*a*, 3*b*. The control unit 22, XRAM 24, YRAM 25, external RAM 26 and processor 27 compose signal processing means 30 as a whole.

In the electronic musical instrument of FIG. 8, a liquid crystal display 18 is further connected to the control unit 22.

Figure 11:
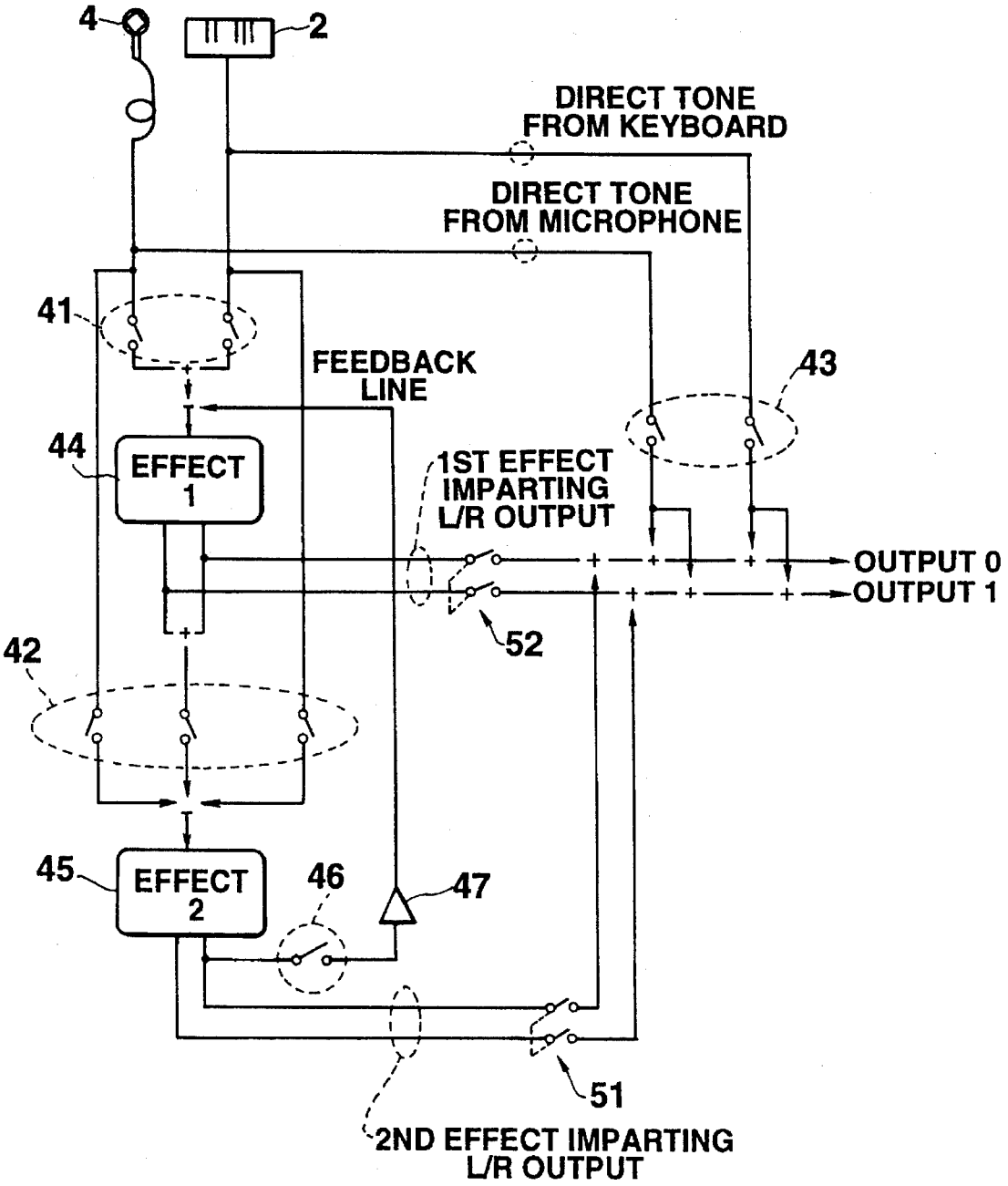
FIG. 11 conceptually illustrates a system for effect impartment realized by the effect imparting apparatus of the embodiment.

FIG. 11 conceptually illustrates an effect imparting system realized by the present apparatus. In FIG. 11, the microphone 4 and the keyboard 2 generate and output a plurality of (in the present embodiment, two) signals. The microphone 4 is the one into which, for example, the user of the musical instrument inputs his voice or the like as required and the microphone outputs an analog signal. The keyboard 2 outputs a digital musical tone signal. In the present embodiment of FIG. 11, the signal from the keyboard 2 includes not a mere key code, but a musical tone signal corresponding to the key code.

The signals from the microphone 4 and the keyboard 2 are input to effect (1) and (2) input selectors 41 and 42 and to a direct tone control switch 43. The effect (1) input selector 41 is realized as a digital software switch by a program to select and output any one or both of the signals from the microphone 2 and the keyboard 2 to a first effector 44 provided in a later stage. The first effector 44 imparts the "effect 1" and in this case, it imparts an effect including "effect 1" to an input signal selected by the effect (1) input selector 41 in this case.

The output of the first effector 44 is input to the effect (2) input selector 42 to which the signals from the microphone 4 and the keyboard 2 are directly input. Thus, the three signals from the microphone 4, the keyboard 2 and the first effector 44 are input the effect (2) input selector 42. Since the effect (2) input selector 42 is realized as a digital software switch in software by a program, any one, two or three of the signals from the microphone 4, keyboard 2 and first effector 44 are selected and output to a second effector 45 in a later stage. The second effector 45 imparts an effect (2) and in this case, it imparts an effect including the "effect 2" to an input signal selected by the effect (2) input selector 42 in this case.

The output of the second effector 45 is fed back through a feedback switch 46 and a multiplier 47 which provides a predetermined feedback gain to the input of the first effector 44, such that a feedback effect to the output of the second effector 45 is obtained. When it is desired to obtain such feedback effect, the feedback switch 46 is turned on.

The output of the second effector 45 is imparted through an effect (2) L/R output switch 51 to a signal on output lines OUTPUT0 and OUTPUT1.

The output of the first effector 44 is imparted through the direct effect (1) L/R output switch 52 to signals on output lines OUTPUT0 and OUTPUT1. The signals from the microphone 4 and the keyboard 2 are imparted directly through a tone control switch 43 to signals on output lines OUTPUT0 and OUTPUT1.

The effect (2) L/R output switch 51, effect (1) L/R output switch 52 and direct tone control switch 43 realize the function of an output form program stored in output form program storage means and determine a form in which the signal with an effect imparted thereto is output. For example, when the direct tone control switch 43 is on and the effect (2) and (1) L/R output switches 51 and 52 are off, the signals from the microphone 4 and the keyboard 2 are directly extracted from the output lines OUTPUT0, OUTPUT1. When the direct tone control switch 43 is off and the effect (2) and (1) L/R output switches 51 and 52 are on and off, respectively, the output from the second effector 45 is directly extracted from the output lines OUTPUT0, OUTPUT1. When the direct tone control switch 43 is off and the effect (2) and (1) L/R output switches 51 and 52 are off and on, respectively, the output from the first effector 44 is directly extracted from the output lines OUTPUT0, OUTPUT1.

When any two or more of the effect (2) and (1) L/R output switches 51 and 52 and the direct tone control switch 43 are on, two or more selected ones of signals from the microphone 4 and the keyboard 2, and the output from the first second effector 44 or 45 are mixed and the resulting signal is extracted from the output lines OUTPUT0, OUTPUT1.

The effect imparting operation of the present apparatus will be described next.

EFFECT GENERAL ROUTINE

Figure 12:
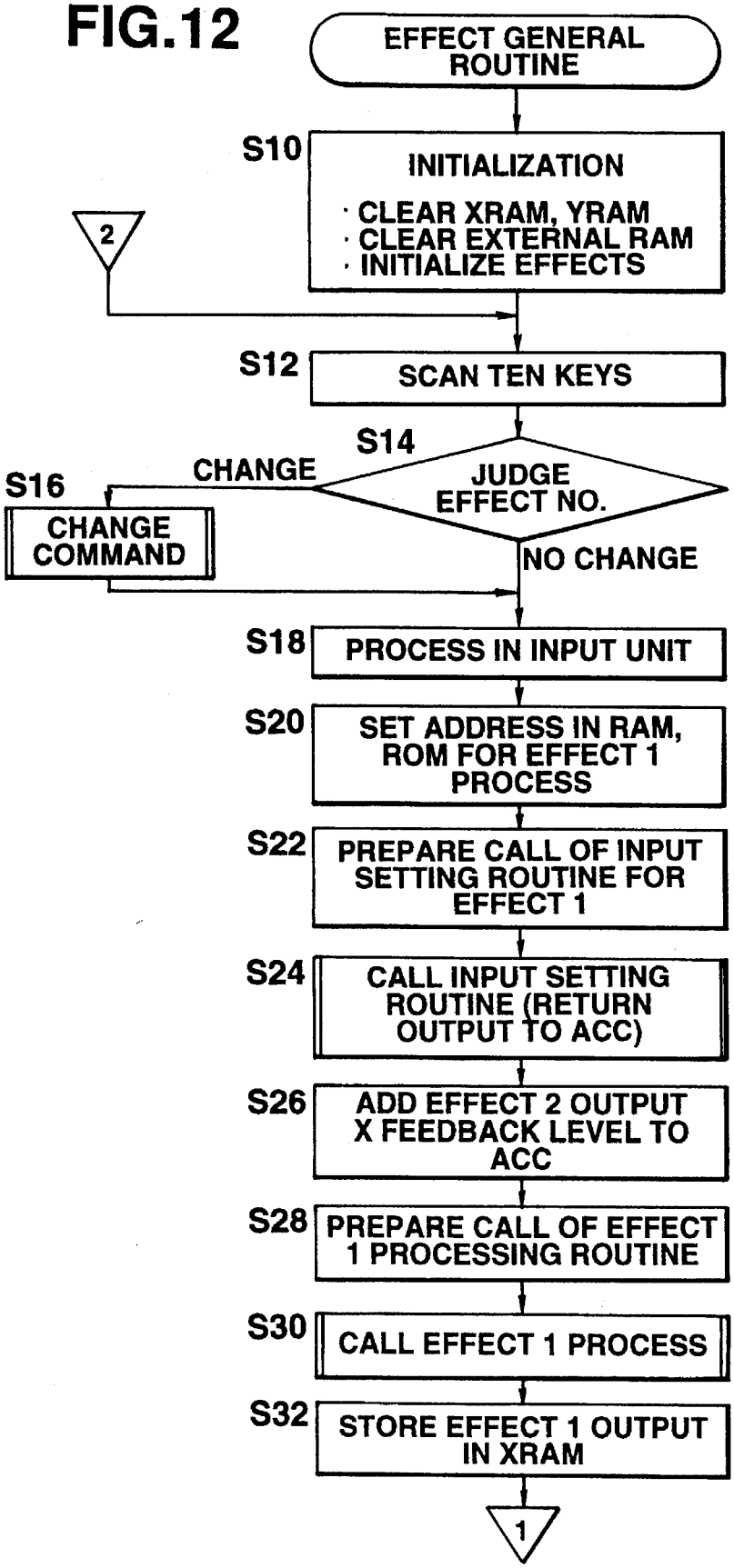
FIG. 12 is a flowchart indicative of part of an effect general routine executed in the embodiment.
Figure 13:
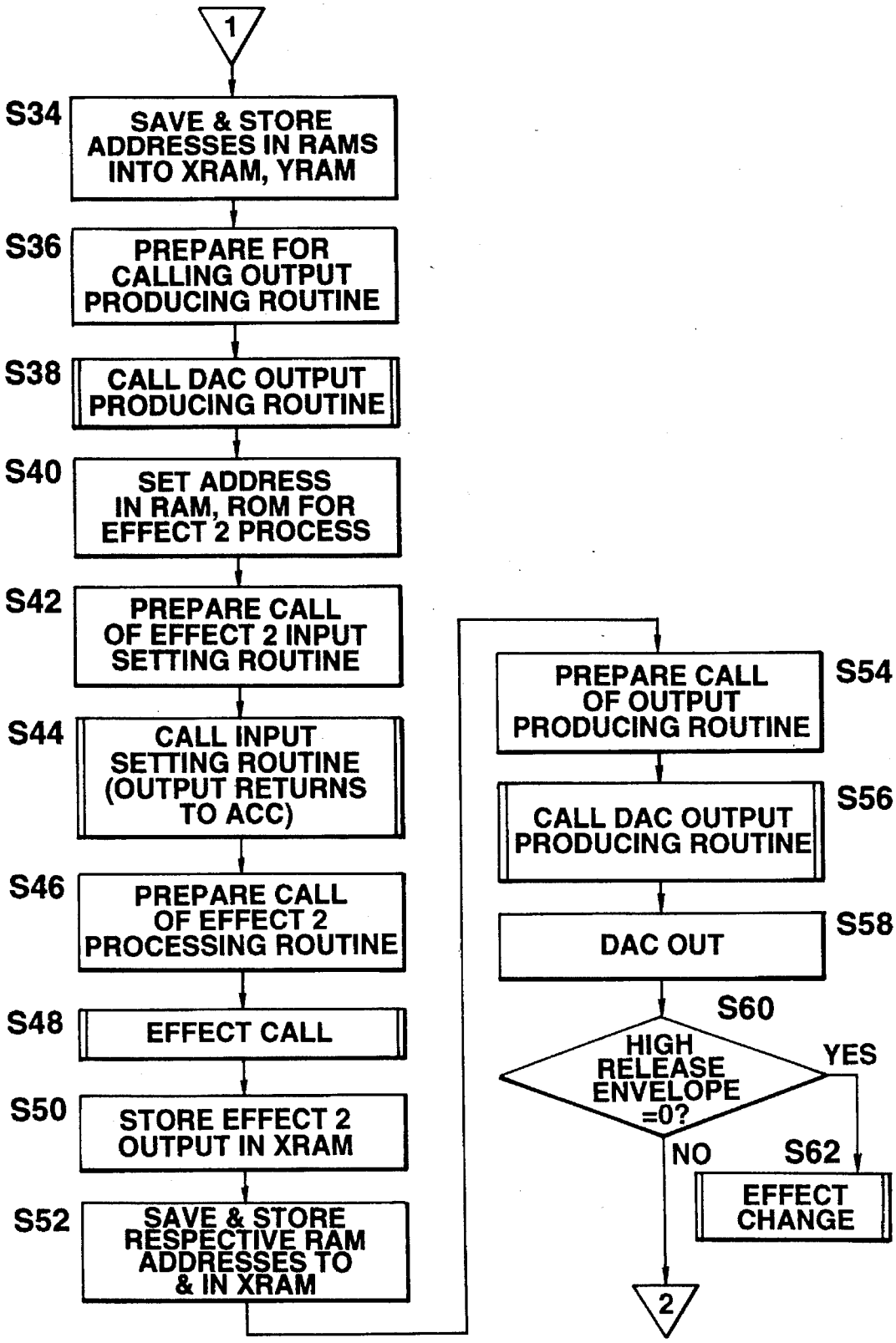
FIG. 13 is a flowchart indicative of part of an effect general routine executed in the embodiment.
Figure 15:
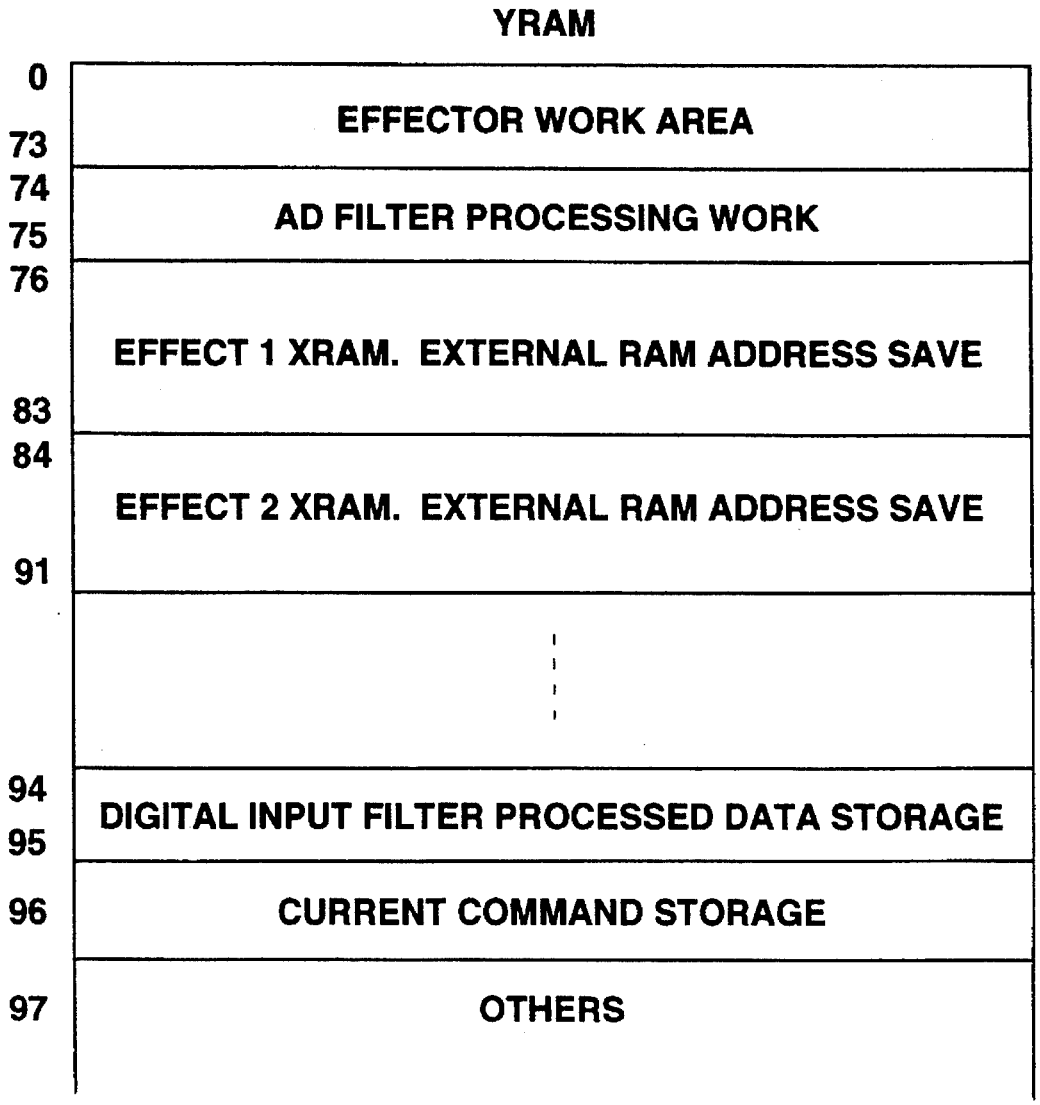
FIG. 15 shows a work area, a data storage area, etc., of a YRAM in correspondence to addresses in the embodiment.

FIGS. 12 and 13 are flowcharts indicative of two portions of an effect general routine. FIG. 14 shows a work area, a data storage area, etc., of the XRAM 24 in correspondence to address. Similarly, FIG. 15 shows a work area, a data storage area, etc., of the YRAM 25 in correspondence to address.

At step S10 "00" (FIG. 2) is set from among a plurality of predetermined effect banks as initial effect setting at the start of the system to thereby perform an initializing process, in which the work RAMs (that is, XRAM 24, YRAM 25 of FIG. 9) and the external RAM 26 are cleared. Simultaneously, header data having a format such as is shown in FIG. 10 is read out of an area in the data ROM 23 corresponding to the effect "00" for effect processing, and the read data are set at predetermined locations. Thus, in the initial state, an effect corresponding to the initial effect number "00" is imparted to the input signal. When a liquid crystal display 18 is provided, "00" is displayed on that display 18.

At step S10 initialization is performed. Other required data is read out of the data ROM 23 and set at predetermined locations in XRAM 24 and YRAM 25.

The addresses "0"–"219" in the XRAM 24 are ensured for an effector work area and the addresses "221", "222" in the XRAM 24 are ensured for a system work area. The addresses "0"–"73" in the YRAM 25 are ensured for an effector work area.

The control unit 22 scans the keys of the ten-key unit 11 at step S12, and judges the effect number at step S14. If the current effect number is different from the previous recorded one, control passes to step S16 to change the command, which will be described later in a subroutine. If the effect number is not different from the previous recorded one, control jumps step S16 to step S18 or a regular effect processing routine.

At step S18 processing in the input unit (in a subroutine to be described later) is performed which includes required processing performed on a plurality of input signals from the microphone 4 and the keyboard 2 and storage of the result of the processing at predetermined locations in the XRAM 24 and YRAM 25. Control then passes to step S20, where address control data (START, END, WIDTH, POINT, OFFSET, LOOP, etc.) for the "effect 1" in the respective ROMs set in the XRAM 24 and YRAM 25 as preparations for the "effect 1" processing are set in the respective address control units of the control unit in order to prepare for an operation for the effect "00".

In order to prepare for calling an input setting routine for the effect 1 at step S22, an input setting routine 1 address at address "230" in the XRAM 24 is set in a subroutine call register and the input setting routine is called at step S24. This sets the on/off state of the effect 1 input selector 41 of FIG. 5, on the basis of which state the analog input or the digital input is selected or they are added, and the selected one or the result of the addition is returned as an input for the effect 1 to the accumulator ACC.

Control then passes to step S26, where the result of (the output of the second effector 45)×(the feedback level) is imparted to the output of the ACC. The result of the impartment is used as an input to the first effector 44 or the ACC. Thus, the input data in this case is created in the ACC of the processor 27. Data on the feedback level is stored at address "224" of the XRAM 24.

At step S28 data on the effect 1 destination address stored at address "228" in XRAM 24 is set in the subroutine call register to prepare for calling the effect 1 processing routine in which an effect such as reverberation is imparted to the input signal. If the effect number is "00", a preparation is made for calling a processing routine in which an effect such as a reverberation or delay is imparted to produce a sensation of the sound field of a "small hall".

At step S30 the effect 1 processing routine is called (that is, the subroutine is read out) to perform a process for impartment of the effect 1 in the first effector 44. In this case, output data is calculated on the basis of input data from the accumulator in accordance with a predetermined algorithm in the effect 1 process. Thereafter, at step S32 the output data, that is, from the first effector 44 (effect 1), is stored at the effect 1 LEFT and RIGHT output storage locations at addresses "238" and "239", respectively, in the XRAM 24. In this way, the process for imparting the effect 1 is performed by the first effector 44.

Now, referring to FIG. 13, at step S34 the respective ROM and RAM address control data for the effect 1 are saved to and stored at predetermined locations in the XRAM 24 and YRAM 25 in preparation for an effect 2 process. More specifically, the YRAM addresses for the effect 1 are saved to addresses "244"–"247" in the XRAM 24, and the XRAM addresses for the effect 1 and the external RAM address are saved to addresses "76"–"83" in the YRAM 25. At step S36, in order to enter the result of the operation of the effect 1 into a predetermined effect output producing routine, the effect output producing routine address at address "233" in the XRAM 24 is set in the subroutine call register for call preparation. At step S38 the effect output producing routine is called, and required data is stored at effect DAC output LEFT and RIGHT storage locations at addresses "242" and "243", respectively, in the XRAM 24.

In this way, the output data for the effect 1 is stored at the effect DAC output storage locations. Thereafter, when the processing for the effect 2 is completed, the final effect output data is composed, and this data is converted to an analog signal in the output unit 28, which then provides the analog signal which includes the input signal with the effect imparted thereto.

Similarly, processing for the effect 2 is performed thereafter. First, at step S40 address control data (START, END, WIDTH, POINT, OFFSET, LOOP, etc.) for the effect 2 in the respective ROM and RAM set in the XRAM 24, YRAM 25 in preparation for the effect 2 process are set in the respective address control units.

At step S42, in order to prepare for calling an input setting routine for the effect 2, an input setting routine 2 address in the XRAM 24 is set in the subroutine call register, and the input setting routine is called at step S44. This routine sets the on/off state of the effect 2 input selector 42 of FIG. 11, on the basis of which state the analog input, the digital input or the output of the effect 1 is selected or they are added and the selected one or the result of the addition is returned as an input for the effect 2 to the accumulator ACC.

Control then passes to step S46, where data on the effect 2 destination address stored at address "229" in the XRAM 24 is set in the subroutine call register to prepare for calling the effect 2 processing routine. At step S48 the effect 2 processing routine is called (that is, the subroutine is read out) to perform a process for impartment of the effect 2 to thereby perform the processing of the second effector 45. In this case, output data is calculated from input data (from the accumulator) in accordance with a predetermined algorithm in the effect 2 process. Thereafter, at step S50 the output data, that is, from the second effector 45 (effect 2), is stored at the effect 2 LEFT and RIGHT output storage locations at addresses "240" and "241", respectively, in the XRAM 24. In this way, the process for imparting the effect 2 is performed by the second effector 45.

Now, at step S52 the respective ROM and RAM address control data for the effect 2 are saved to and stored at predetermined locations in the XRAM 24 and YRAM 25. More specifically, the YRAM addresses for the effect 2 are saved to addresses "248"–"251" in the XRAM 24, and the XRAM addresses for the effect 2 and the external RAM address are saved to addresses "84"–"91" in the YRAM 25. At step S54, in order to enter the result of the operation of the effect 2 into a predetermined DAC producing routine, the effect output producing routine address at address "233" in the XRAM 24 is set in the subroutine call register for call preparation. At step S56 the DAC output producing routine is called and required data is stored at effect DAC output LEFT and RIGHT storage locations at addresses "242" and "243", respectively, in the XRAM 24.

In this way, the output data for the effect 2 is stored at the effect DAC output storage locations and the final effect output data based on the effects 1 and 2 is composed.

At step S58 a DAC output process is performed in which the output composition data of the final effect including the effects 1 and 2 is subjected to digital-to-analog (DA) conversion in the output unit 28 to output a signal including the input signal with the imparted effect.

At step S60 it is determined whether a high release envelope is "0". This envelope is used for attenuating the level of a signal at high speed, for example, when the effect is changed to another. Thus, when the high release envelope is "0" at step S60, it is determined that the effect is required to be changed. Thus, control passes to step S62 to change the effect. When the high release envelope is not "0", control returns to step S12 to repeat processing similar to the above.

PROCESSING IN THE INPUT UNIT

Figure 16:
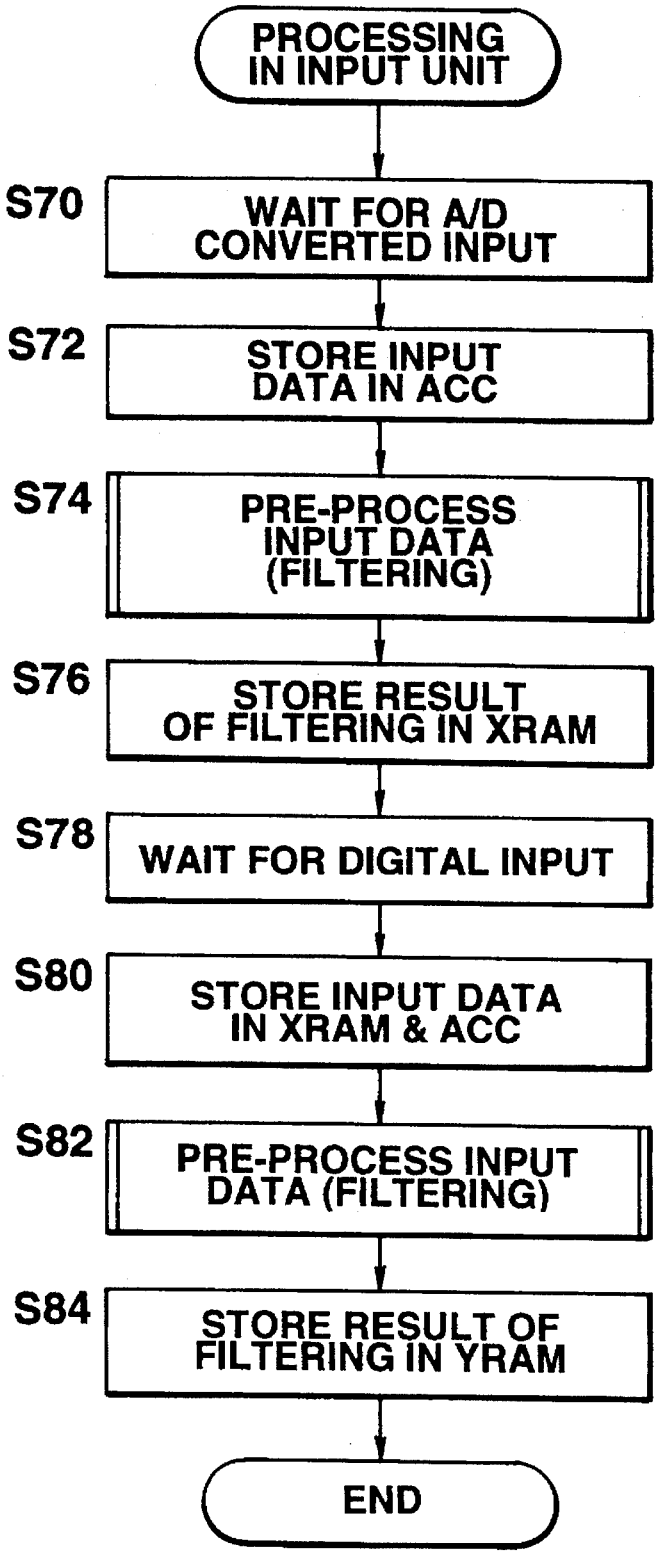
FIG. 16 is a flowchart indicative of a subroutine for processing in the input unit in the embodiment.

FIG. 16 is a flowchart indicative of a subroutine for processing in the input unit at step S18 of the effect general routine. When this subroutine starts, control waits for an AD (analog-to-digital) converted input at step S70. This is performed by determination of a flag (conversion end flag) because an analog signal from the microphone 4 is subjected to analog-to-digital conversion at predetermined interval of time (sample period) in the analog-to-digital converter, the flag is set thereafter, and input data which has been subjected to analog-to-digital conversion is readable after the setting of the flag. The processing at the steps S70–S76 corresponds to blocks for processing a signal received from the microphone 4 while the steps S78–S84 correspond to blocks for processing a signal received from the keyboard 2.

If there is the conversion end flag at step S70, input AD converted data is readable. At the next step S72 the input AD converted data is stored in the accumulator (ACC). When the input data which has been subjected to AD conversion is read, the conversion end flag disappears. At step S74 the input data is subjected to digital filtering as pre-processing which is performed before the data is input to the effect imparting process. At step S76 data on the result of the filtering is stored at an AD converted input value storage location at address "234" in the XRAM 24. In the method described above, the analog signal from the microphone 4 is converted to a digital signal, which is then stored.

Next, a digital signal input from the keyboard 2 will be processed. First, at step S78 control waits for the digital signal from the keyboard 2, which is made by judging a data input flag which is set each time a digital signal is received from the keyboard 2. When the data input flag is set at step S78, digital waveform data is readable. At the next step S80 this data is stored at a digital input value storage location at address "235" in XRAM 24 and also in the ACC.

When the digital waveform data has been read, the data input flag disappears. At step S82 digital filtering is made as pre-processing which is performed before data is input to the effect imparting process. At step S84 data on the result of the filtering is stored at a digital input filter processed data storage location at address "94" in the YRAM 25. This stored data is also used in the next filtering operation. In the meantime, the control unit 22 sends/receives data to/from the processor 27, as required, to set addresses in the RAMs (XRAM 24, YRAM 25, external RAM 26) necessary for the filtering operation and to manage the flag. In this way, the digital input signal received from the keyboard 2 is fetched.

COMMAND CHANGING PROCESS

Figure 17:
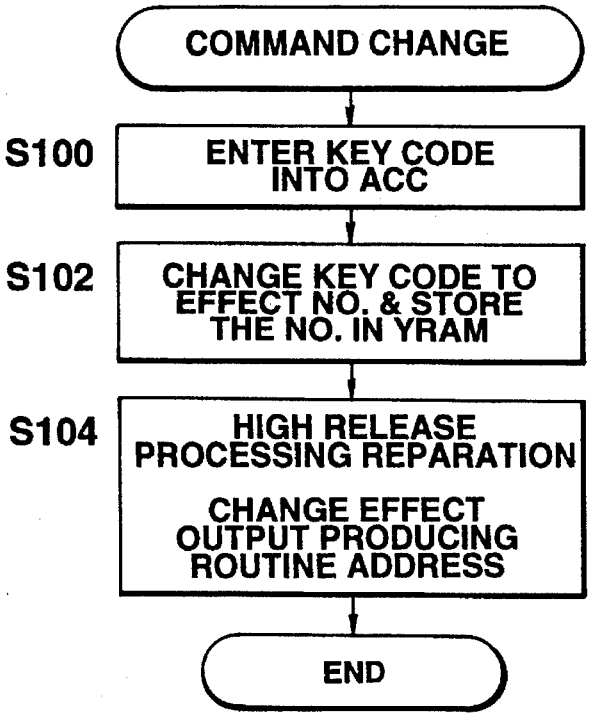
FIG. 17 is a flowchart indicative of a command changing subroutine executed in the embodiment.

FIG. 17 is a flowchart indicative of a subroutine of a command changing process at step S16 of the effect general routine. When this subroutine starts, first, at step S100 a key code produced by the depression of a key in the ten-key unit 11 is sent to the ACC. This key code corresponds to designation of a new effect number. At step S102 the input key code is converted to an effect number, which is stored in a current effect number area or at a current command storage location at address "96" in YRAM 25. If a liquid crystal display 18 is provided, the effect number is displayed on the display 18.

At S104, in order to perform high release processing, an address for calling an effect output producing routine and stored at address "233" in XRAM 24 is changed. Each time an effect output is produced the effect output is multiplied by a high release envelope to thereby cause the current effect output tone to perform high release processing and control then returns to the normal effect processing.

As just mentioned above, by keying in a new key code at the ten-key unit 11, a corresponding new effect number is designated, and high release processing is performed to switch the old effect smoothly to a new effect imparted to the input signal.

EFFECT CHANGING PROCESS

Figure 18:
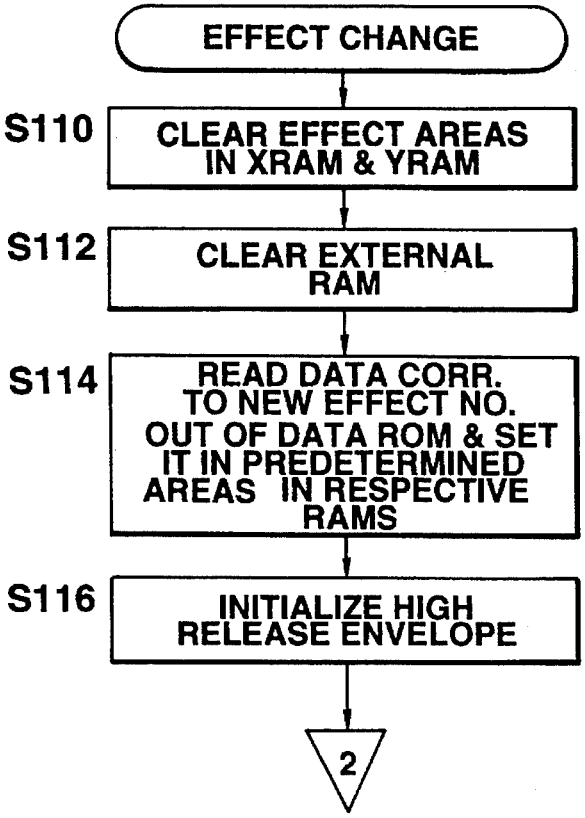
FIG. 18 is a flowchart indicative of an effect changing subroutine executed in the embodiment.

FIG. 18 is a flowchart indicative of a subroutine for an effect changing process at step S62 of the effect general routine. When this subroutine starts, the effect areas of XRAM 24 and YRAM 25 are cleared at step S110 and the external RAM 26 is cleared at step S112. Control then passes to step S114 where data corresponding to the new effect number is read out of the ROM 23 and set at predetermined locations in the XRAM 24 and YRAM 25. At step S16 the high release envelope is initialized to an initial value (for example, of "1") and control returns to the effect general routine.

As described above, the cycle of the effect general routine is repeated until the command changes. When the command changes in the course of repetition of the effect general routine, the command change process is performed. A tone erasing envelope (high release envelope) data on which is stored at address "237" in the XRAM 24 is reduced at a given rate in the DAC output producing routine, the resulting envelope is multiplied by the signal with the effect and the resulting signal is output, which performs tone erasure. The tone erasure envelope (high release envelope) data on which is stored at "237" in the XRAM 24 becomes "0". That is, when the tone erasure is completely ended, control passes to the effect changing process, where a new effect is imparted to the signal.

As just described above, in the present embodiment, no independent program is required to be provided for each of the various imparted effects and the forms of effect impartment. When a new effect number is designated by a key of the ten-key unit 11, data corresponding to the new effect number are read out of the data ROM 23 in which various data for allowing selection of any one of the kinds of effects to be imparted and any one of the forms of effect impartment are beforehand stored solely in the data ROM 23 and the read data are set at predetermined locations in the XRAM 24 and YRAM 25, and the subroutines called with the read data are combined to form one program, in which the input signal is processed. At this time, the high release envelope is initialized to an initial value, for example, of "1", to erase the tone. Thereafter, a new effect is imparted to the input signal on the basis of the various data stored in the XRAM 24 and YRAM 25.

Thus, although the kinds of effects imparted to a plurality of input signals and the forms of effect impartment are changed by the ten-key unit 11, the capacity of the memory which stores a program (in this case, data ROM 23) and the cost are reduced compared to the conventional apparatus which has memories each storing an independent program, and data access time is not increased, advantageously.

Even if the number of effects to be selected and the number of forms of effect impartment increase, an effect number is only required to be designated by the ten-key unit. Thus, the number of operators, for example switches, to select an effect and the form of effect impartment is reduced.

In addition, the inventive apparatus can impart more kinds of effects to the input signal and can freely select more forms of effect impartment, using the same capacity of a memory (data ROM 23), than the conventional apparatus.

The effects to be imparted are not limited to those shown in the above Figures, but other various effects may be imparted and the forms of effect impartment are not limited to the examples of the above Figures.

The input signals are not limited to those from the microphone and the keyboard, but may be other signals.

B. SECOND EMBODIMENT

This embodiment relates to an example in which the kinds of effects to be imparted to a single input signal and the number of kinds of effect impartment are changed by designation of a select key.

Figure 19:
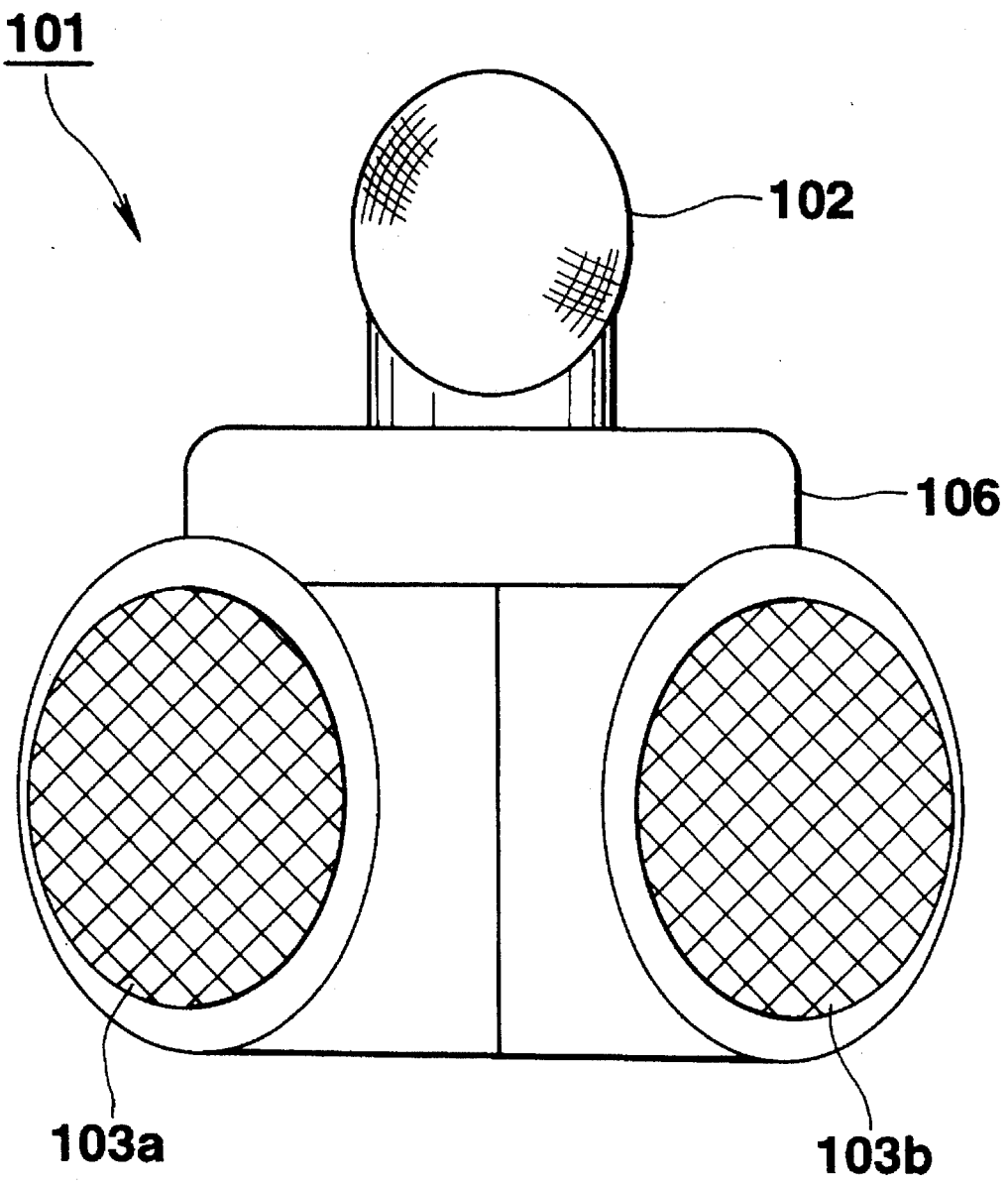
FIG. 19 is a front view of an effect microphone device as a second embodiment of the present invention.
Figure 20:
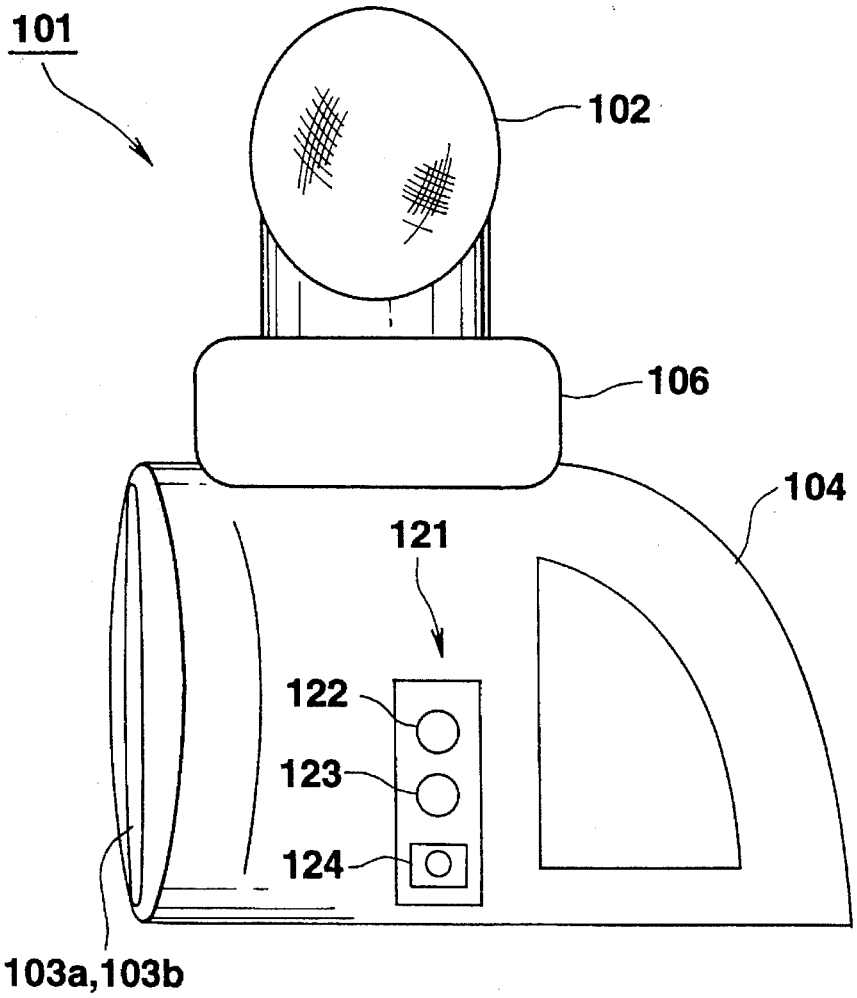
FIG. 20 is a side view of the effect microphone device of FIG. 19.

FIG. 19 is a front view of a microphone device with an effect imparting apparatus (digital effector) according to the present invention. FIG. 20 is a side view of the microphone device. In FIGS. 19 and 20, reference numeral 101 denotes a colorful microphone device body made, for example, of a resin material. The microphone body 101 has an upper cylindrical portion to an upper end of which a microphone 102 is provided. The microphone 102 is non-directional so that two persons's voices in a duet are conveniently input through the microphone device. The microphone 102 is covered with a soft material such as sponge (not shown).

The microphone body 101 takes the form of a solid having a horizontal substantially triangular cross section as a whole and has a pair of elliptical speakers 103*a*, 103*b* on a front thereof. These speaker 103*a*, 103*b* produce in two directions performance outputs containing a voice from the microphone. The microphone device body 101 has a pair of handles 104 (one handle alone is shown) such that a singer who sings a song to a recorded orchestral accompaniment melody grips any one of those handles 104 so as to support the microphone device body 101. The reason for provision of the pair of handles is that, for example, two singers in a duet can grip those handles in both directions.

Figure 21:
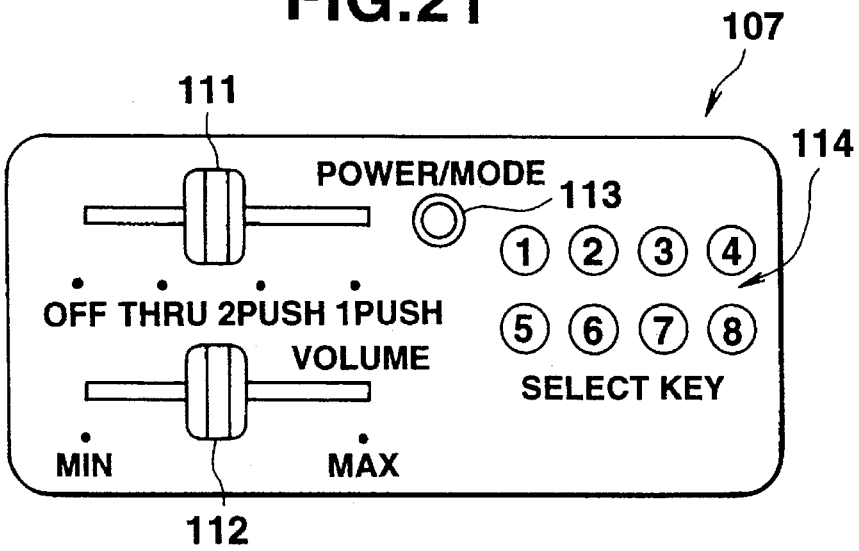
FIG. 21 shows the detailed structure of an operating panel of the second embodiment.

The microphone device body 101 is fixed at its upper cylindrical end to a panel base 106, which takes the form of a solid having a horizontal substantially triangular cross section. The panel base 106 has an operation panel 107, the details of which are shown in FIG. 21. In FIG. 21, the operation panel 107 is provided with a power supply/mode switch 111, a volume 112, a power supply/mode display lamp 113 and a select key unit 114.

The power supply/mode switch 111 used is of the type which slidable horizontally. The power supply/mode switch 111 has an "OFF" position (a power supply for the microphone device body 101 is turned off at the "OFF" position and on at any other position); a position "THRU" where the original signal without any effects is passed through the apparatus; a position "2PUSH" where a key of the select key unit 114 is pushed twice for selection of the corresponding mode; and a position "1PUSH" where a key of the select key unit 114 is pushed once for selection of the corresponding mode.

The volume 112 is of the type which is slidable horizontally to adjust the output level of the speakers 103*a*, 103*b*. The power supply/mode display lamp 113 is lighted depending on the selected state of each mode and the slide position of the power supply/mode switch 111. The select key unit (select means) 114 has 8 keys "1"–"8", depression of any one or two of which selects the number of an effect imparted to the input signal (in this case, from the microphone). The select key unit 114 selects one from a plurality of effects as in the previous embodiment and stored beforehand as "EFFECT BANK" in the form of programs. In the second embodiment, no effect name No. list display is provided, but such display may be disposed at a predetermined position in the microphone device body 101 or may be affixed to a manual for this apparatus.

Figure 22:
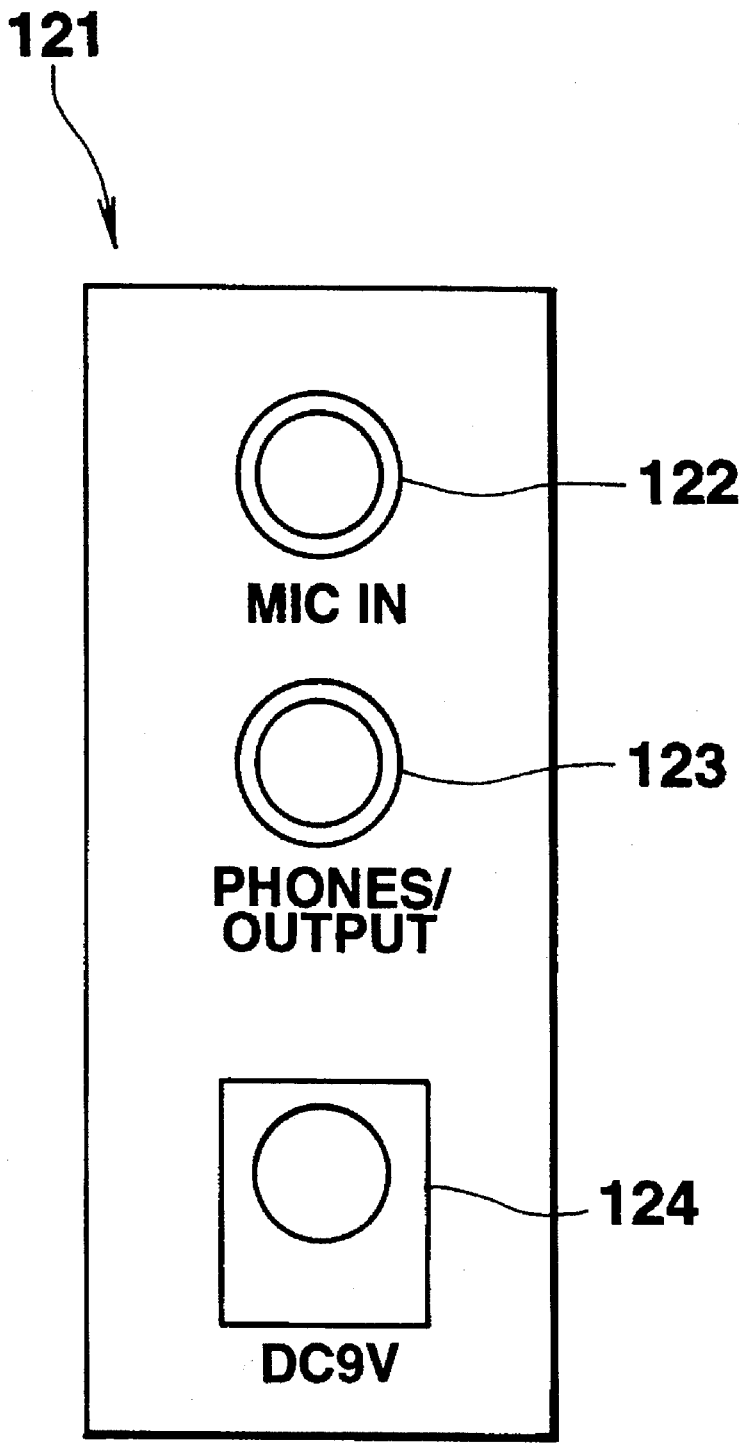
FIG. 22 shows the detailed structure of a terminal panel of the second embodiment.

The microphone body 101 has a terminal panel 121 on one side thereof. The terminal panel 121 is provided thereon with a microphone input jack 122, a headphone output jack 123 and a power supply jack 124 as shown in detail in FIG. 22 on an enlarged scale. The microphone input jack 122 is used to connect an external microphone thereto. For example, when two persons sing a song in a duet at a place remote from the microphone device body 101, a plug of the external microphone is inserted into the microphone input jack 122 so that a different voice from that of the microphone 102 can be input into the microphone device. The headphone output jack 123 is used to connect a headphone thereto. When a plug of the headphone is inserted into the headphone output jack 123, the speakers 1, 103*a* and 103*b* stop producing sounds and instead, the headphone receives an signal input thereto.

The power supply Jack 124 receives a plug of an external power supply, for example, of DC 9 volts. The microphone device body 101 is provided with an internal power supply, for example, of a dry cell which normally supplies required operating power to the elements concerned.

Figure 23:
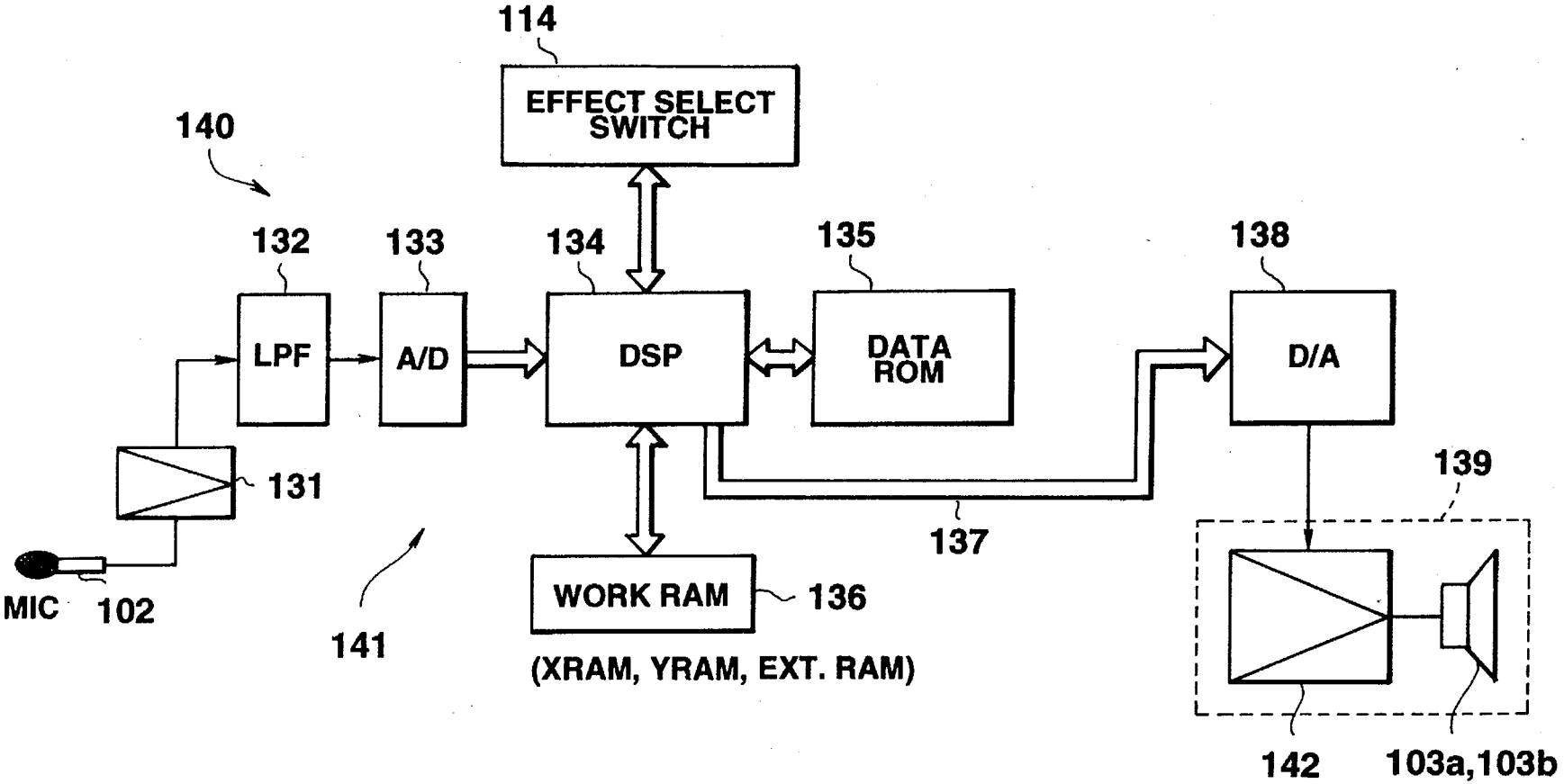
FIG. 23 is a block diagram of the effect imparting apparatus of the second embodiment.

FIG. 23 is a block diagram of an effect imparting apparatus provided to the microphone device body 101. In FIG. 23, the effect imparting apparatus is provided with an effect select switch unit 114(corresponding to the above-mentioned select key); an amplifier 131; a low pass filter 132; an analog-to-digital converter 133; a DSP 134; a data ROM 135; a work RAM 136; a bus 137; a digital-to-analog converter 138; and an output unit 139.

An effect select switch 114 designates the number of a desired effect by depression of a key corresponding to a numeral of one or double figures from among a plurality of predetermined effects to produce and send the corresponding signal to the DSP 134. The analog signal from the microphone 102 is amplified by the amplifier 131 and the resulting signal is sent through the low pass filter 132 to the analog-to-digital converter 133 where it is converted to a digital signal, which is then sent to the DSP 134. The microphone 102, amplifier 131, low pass filter 132, and analog-to-digital converter 133 compose input means 140 as a whole. The input means 140 receives only an analog signal from the microphone 102 in the present embodiment.

The DSP 134 realizes the functions of the control unit and processor of the previous embodiments. It reads the effect number designated by the effect select switch 114 to read the corresponding header data out of the data ROM 135, sends/receives data to/from the A/D and D/A converters 133 and 138 and controls addresses and data in the work RAM 136. The data ROM 135 stores header data and parameters corresponding to effects and forms of effect impartment. More particularly, it beforehand stores data on effect programs corresponding to effects to be imparted to the input signals, and an output form program which determines a form in which the signal with an imparted effect is output. Thus, the data ROM 135 has the function of program storage means.

The work RAM 136 realizes the functions of the XRAM, YRAM and external RAM in the previous embodiments. In this case, the XRAM and YRAM are used in the operation for effect impartment, storage of a routine address to control of the inputs/outputs, and temporary stock of input/output data. The external RAM is used as a work area in the signal processing for effect impartment (for example, signal delay, using the external RAM as a delay RAM, etc.). The DSP 134 and the work RAM 136 compose signal processing means 141 as a whole.

The data from the DSP 134 is sent through the bus 137 to D/A converter 138, where the data is subjected to D/A conversion and the resulting analog signal is sent to the output 139. The output 139 is composed of an amplifier 142 and speakers 103*a*, 103*b* such that it amplifies the analog signal and causes the speakers 103*a*, 103*b* to produce sounds based on the analog signal.

Figure 24:
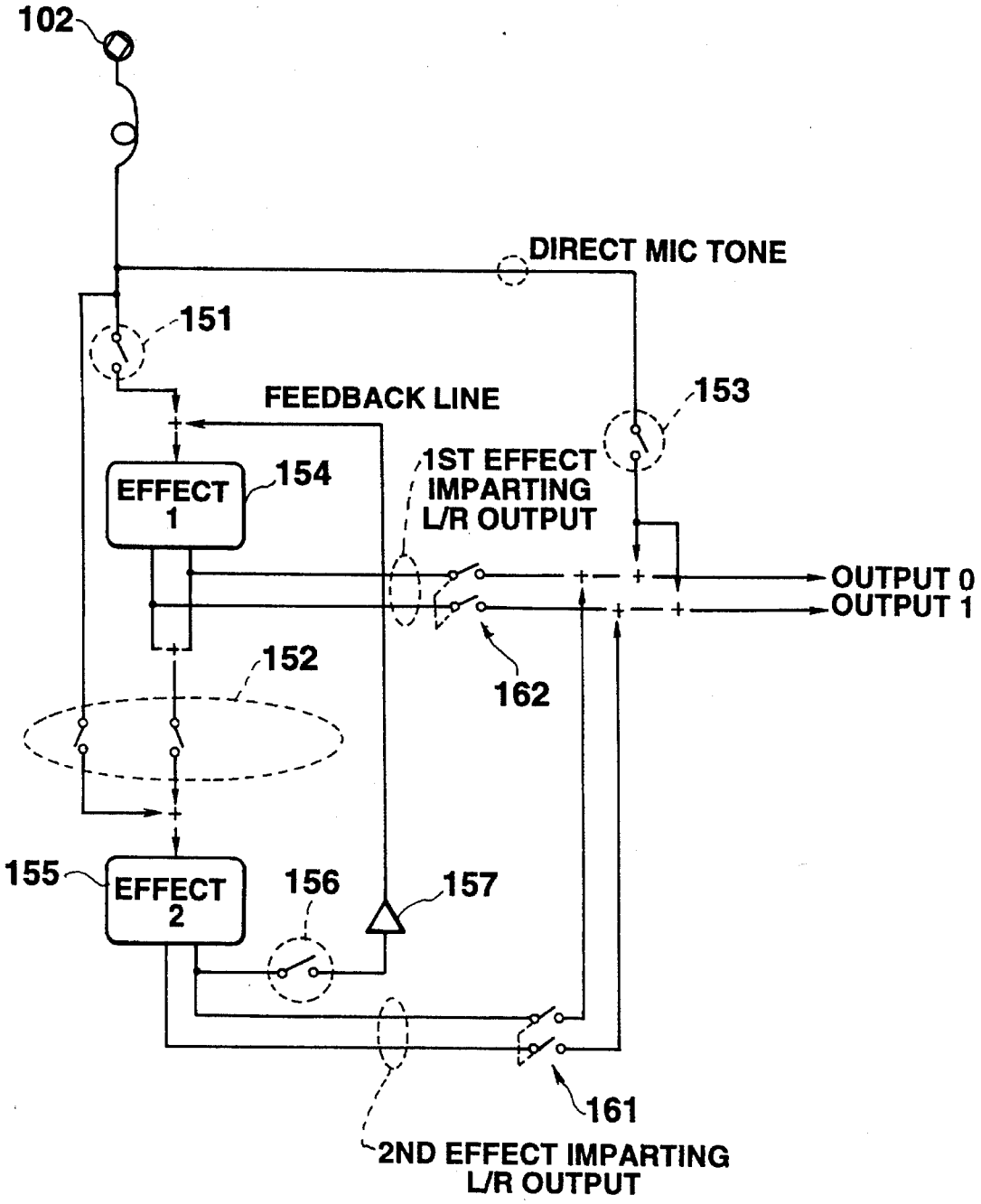
FIG. 24 conceptually illustrates an effect imparting system realized by the effect imparting apparatus of the second embodiment.

FIG. 24 conceptually shows an effect imparting system realized by the present apparatus. In FIG. 24, the microphone 102 is the one into which, for example, the user of the apparatus inputs his voice or the like as required. The microphone 102 outputs an analog signal. The signal from the microphone 102 is input to effect (1) and (2) input selectors 151 and 152 and a direct tone control switch 153. The effect (1) input selector 151 is realized as a digital software switch in software by a program to select a signal from the microphone 102 (in the embodiment, by turning on the selector 151) and outputs the signal to a first subsequent effector 154. The first effector 154 imparts the "effect 1" to an input signal selected by the effect (1) input selector 151 in this case.

The output of the first effector 154 is input to the effect (2) input selector 152 to which the signal from the microphone 102 is directly input. Thus, a signal from the microphone 102, and two signals from the first effector 154 are input the effect (2) input selector 152. The effect (2) input selector 152 is realized as a digital software switch in software by a program. Any one or two of the signals from the microphone 102 and first effector 154 are selected and output to a second effector 155 in a later stage. The second effector 155 imparts an effect (2) to an input signal selected by the effect (2) input selector 152 in this case.

The output of the second effector 155 is fed back through a feedback switch 156 and a multiplier 157, which provides a predetermined feedback gain to the input of the multiplier 157, to the input of the first effector 154, such that a feedback effect to the output of the second effector 155 is obtained. When it is desired to obtain such feedback effect, the feedback switch 156 is turned on.

The output of the second effector 155 is added through an effect (2) L/R output switch 161 to signals on output lines OUTPUT0 and OUTPUT1.

The output of the first effector 154 is added through an effect (1) L/R output switch 162 to signals on output lines OUTPUT0 and OUTPUT1. The signals from the microphone 102 is added through a direct tone control switch 153 to signals on output lines OUTPUT0 and OUTPUT1.

The effect (2) L/R output switch 161, effect (1) L/R output switch 162 and direct tone control switch 153 realize as a whole the function of the output form program stored in the program storage means and determine a form in which the signal with an effect imparted thereto is output. For example, when the direct tone control switch 153 is on and the effect (2) and (1) L/R output switches 161 and 162 are off, the signal from the microphone 102 is directly extracted from the output lines OUTPUT0, OUTPUT1. When the direct tone control switch 153 is off and the effect (2) and (1) L/R output switches 161 and 162 are on and off, respectively, the output from the second effector 155 is directly extracted from the output lines OUTPUT0, OUTPUT1. When the direct tone control switch 153 is off and the effect (2) and (1) L/R output switches 161 and 162 are off and on, respectively, the output from the first effector 154 is extracted from the output lines OUTPUT0, OUTPUT1.

When any two or more of the effect (2) and (1) L/R output switches 161 and 162 and the direct tone control switch 153 are on, two or more selected signals from the microphone 102 and the respective outputs from the first and second effectors 154 and 155 are mixed and the resulting signal is extracted from the output lines OUTPUT0, OUTPUT1.

The effect impartment of the present apparatus is realized in a program similar to that used in the previous embodiments in consideration of the fact that the single input signal is used. Thus, with a microphone device where the input signal is only a single signal from the microphone 102, an appropriate effect is imparted to the single signal to thereby produce advantages similar to those produced by the previous embodiments.

C. THIRD EMBODIMENT

Figure 25:
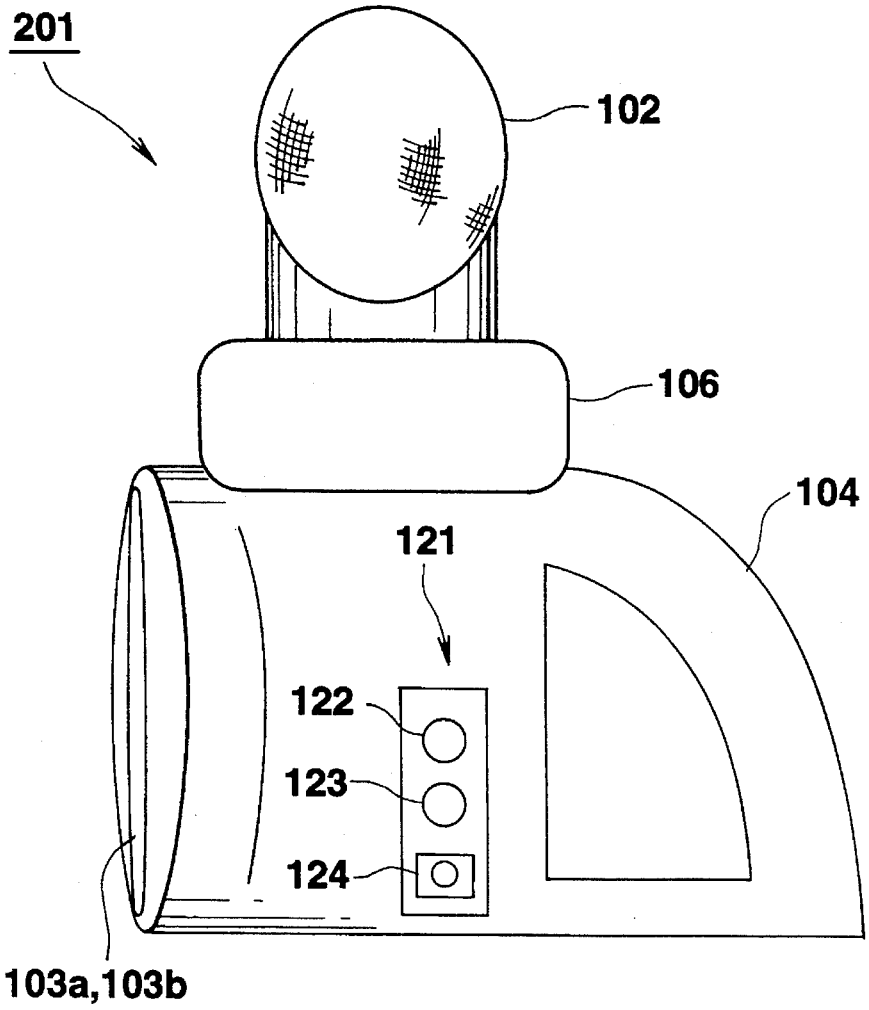
FIG. 25 is a side view of a microphone device of a third embodiment of the present invention.
Figure 26:
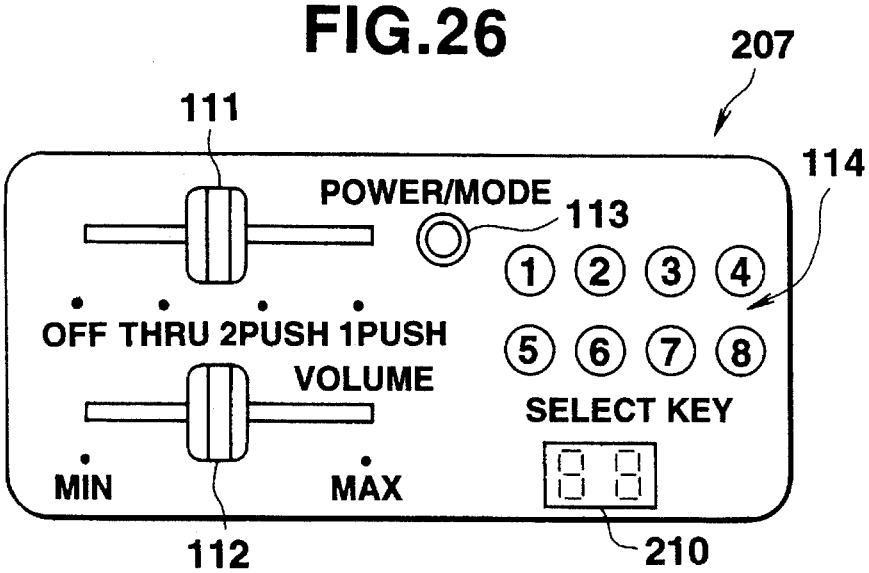
FIG. 26 shows the detailed structure of an operating panel of the third embodiment.

The third embodiment of the present invention is a microphone device as in the second embodiment and different from the second embodiment in that the former embodiment has a display on which the result of the selection by the select key unit 114 is displayed. FIG. 25 is a side view of the microphone device in which an operation panel 207 having a structure different from that of the second embodiment is disposed on a panel base 106 of the microphone device body 201 (The details of the operation panel 207 are shown in FIG. 26). The other remaining structure of the third embodiment is similar to that of the second embodiment and the same reference numeral is used to denote the same element in the Figures corresponding to each other.

In FIG. 26, the operation panel 207 is provided with a power supply/mode switch 111, volume 112, power supply/mode display lamp 113, effect select key unit 114, and liquid crystal display 210 thereon. The liquid crystal display 210 displays a numeral of one or double figures to a maximum designated by the select key unit 114.

Figure 27:
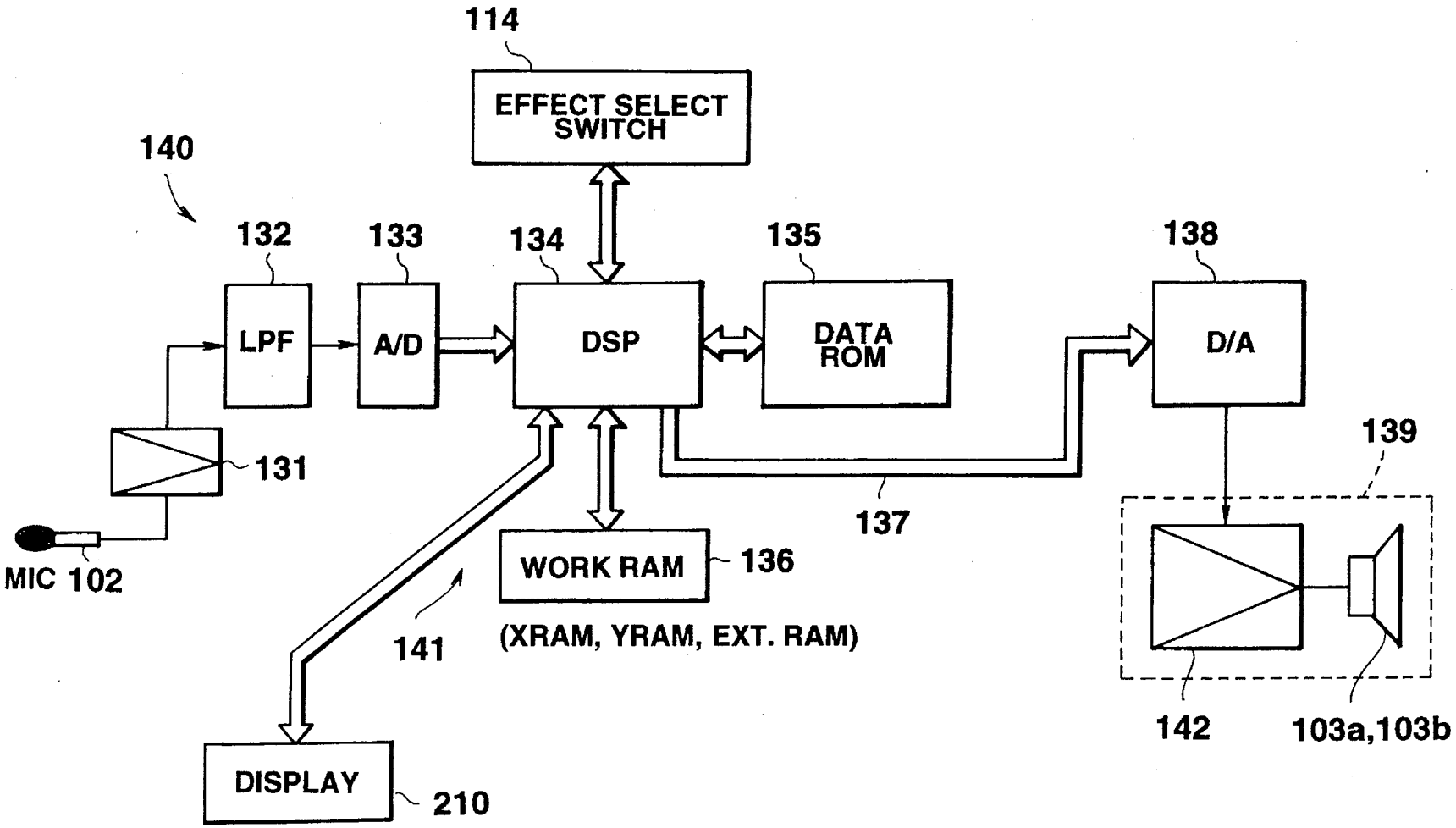
FIG. 27 is a block diagram indicative of an effect imparting apparatus of the third embodiment.

FIG. 27 is a block diagram of an effect imparting apparatus provided to the microphone device body 201. In FIG. 27, the DSP 134 is connected to the liquid crystal display 210. It commands the display 210 to display thereon a numeral corresponding to the result of the selection of a switch of the effect select switch unit 114. Thus, the display 210 displays a corresponding numeral of one or double figures. The third embodiment is substantially similar to the second embodiment and uses in the Figures the same reference numeral as the second embodiment.

Thus, although a numeral designated by the select key unit 114 cannot be viewed in the second embodiment, a numeral of one or double figures designated by the select key unit 114 is easily ascertained on the display 210, advantageously, in the third embodiment.

D. FOURTH EMBODIMENT

Figure 28:
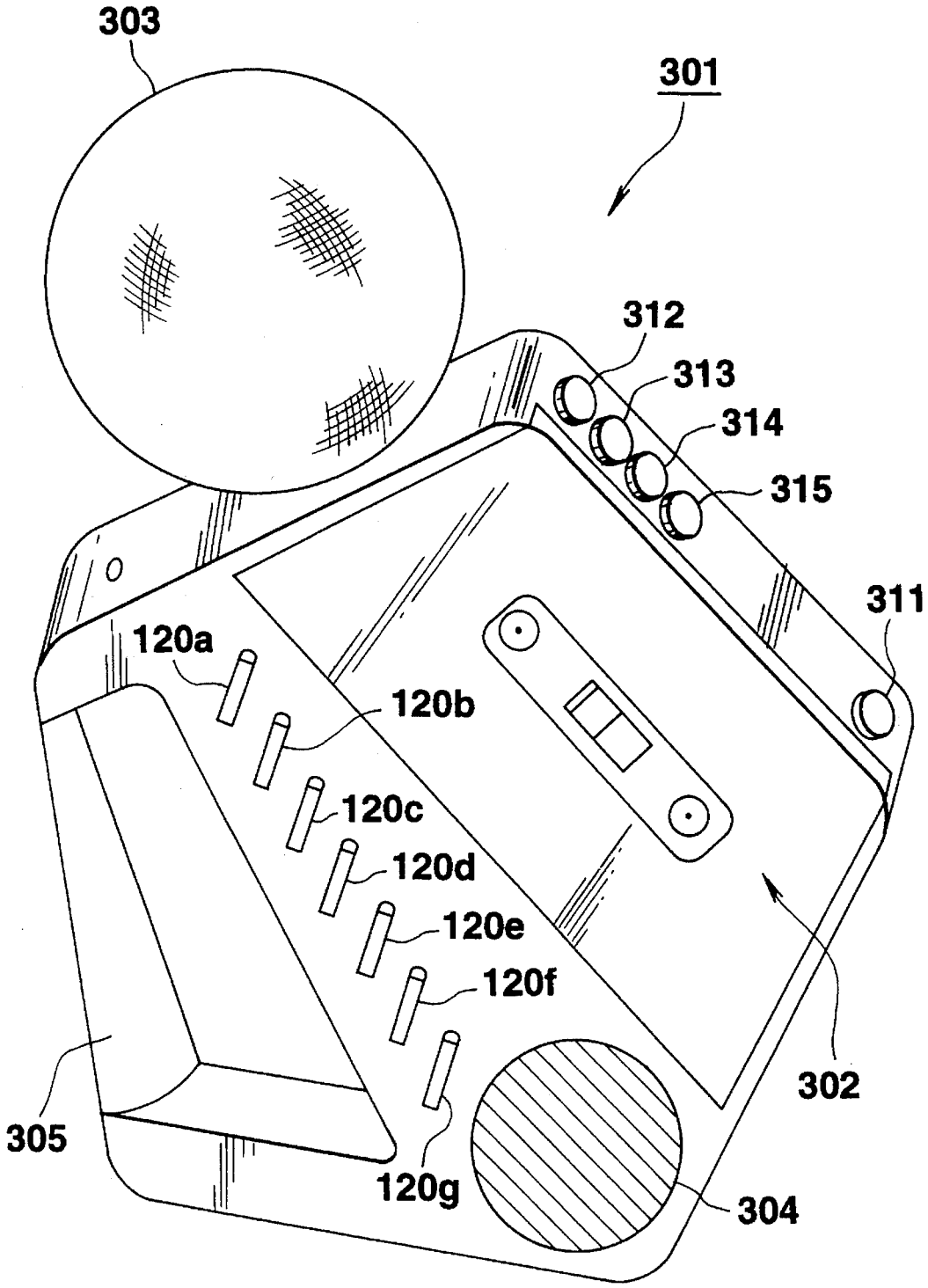
FIG. 28 is a front view of an effect microphone device of a fourth embodiment of the present invention.

The fourth embodiment uses an input signal from a tape recorder as an example. FIG. 28 shows the appearance of a microphone device to which the inventive effect imparting apparatus (digital effector) is applied. In FIG. 28, reference numeral 301 denotes a colorful effect microphone device body with a built-in tape recorder 302 and for example, the main part of the device body is made of a resin material. The tape recorder used may be of the type where a cassette tape of a regular or miniaturized size is used.

The effect microphone device body 301 has a non-directional microphone 303 covered with a soft material such as sponge. The effect microphone body 301 is composed of a solid having a horizontal substantially trapezoidal cross section as a whole. It has on its front a circular speaker 304, which produces an effect output containing a microphone voice forwardly. The effect microphone device body 301 has a handle 305 on one side thereof and having such a size that it is easily gripped by a hand of the user so as to be supported and carried.

The effect microphone device body 301 has various switches disposed on the other side thereof. More specifically, the switches are a power supply switch 311 to turn on/off power to the effect microphone body 301; a play switch 312 to operate the tape recorder 302; a rapid feed switch 313 to feed a tape rapidly; a tape rewinding switch 314; a stop switch 315 to stop the operation of the tape recorder 302; and a volume (not shown) to adjust the volume of the speaker 304.

The effect microphone device body 301 has an effect select switch unit 320 on the front thereof and having 7 keys 320*a*–320*g*, one or two of which can be depressed to select the number of an effect imparted to the input signal (in this embodiment, a microphone signal). The respective keys 320*a*–320*g* of the effect select switch unit 320 may be lighted themselves or display the corresponding numerals "1"–"7" thereon, when depressed.

The effect select switch 320 selects a desired one from a plurality of effects as in the previous embodiments and stored beforehand as "EFFECT BANK" in the form of programs. In the fourth embodiment, no effect No. list display is provided, but such display may be disposed at a predetermined position in the effect microphone device body 301 or may be affixed to a manual for this apparatus. The effect microphone body 301 has an internal power supply (for example, a cell), which normally supplies required operating power to the elements concerned. Alternatively, it may have an external power supply terminal thereon.

Figure 29:
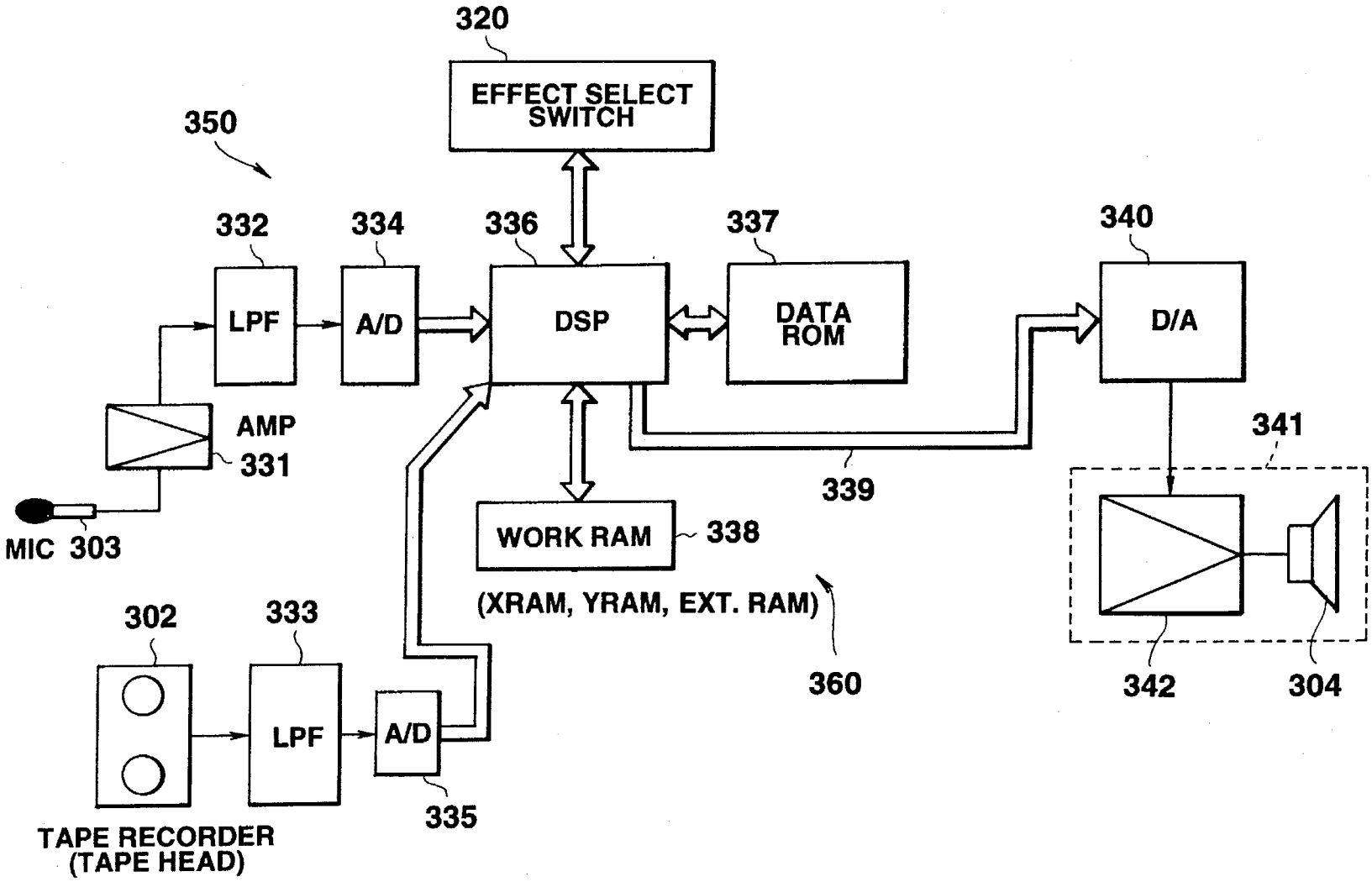
FIG. 29 is a block diagram indicative of an effect imparting apparatus of the fourth embodiment.

FIG. 29 is a block diagram of an effect imparting apparatus provided to the effect microphone device body 301. In FIG. 29, the effect imparting apparatus is provided with an effect select switch unit 20; an amplifier 331; low pass filters 332, 333; analog-to-digital converters 334, 335; a DSP 336; a data ROM 337; a work RAM 338; a bus 339; a digital-to-analog (D/A) converter 340; and an output unit 341.

The effect select switch 320 designates an effect number by depression of a key corresponding to a desired effect from among a plurality of predetermined effects to produce and send a signal indicative of the effect number from the effect select switch unit 320 to the DSP 336.

The analog signal from the microphone 303 is amplified by the amplifier 331 and the resulting signal is sent through a low pass filter 332 to the analog-to-digital (A/D) converter 334 where it is converted to a digital signal, which is then sent to the DSP 336. The analog signal from the tape head in the tape recorder 302 is sent through a low pass filter 333 to the analog-to-digital converter 335, where it is converted to a digital signal, which is then sent to the DSP 336.

The microphone 303, tape recorder 302, amplifier 331, low pass filters 332, 333, and analog-to-digital converters 334, 335 compose input means 350 as a whole. The input means 350 receives analog signals from the microphone 303 and tape recorder 302.

The DSP 336 realizes the functions of the control unit and processor of the previous embodiments. It reads the effect number designated by the effect select switch unit 320, reads the corresponding header data out of the data ROM 337, sends/receives data to/from the A/D converters 334, 335, and D/A converter 340 and controls addresses and data in the work RAM 338. The data ROM 337 stores header data and parameters corresponding to effects and forms of effect impartment.

More particularly, the data ROM 337 beforehand stores input form programs corresponding to the forms of impartment of effects to the respective two input signals, effect programs corresponding to the respective effects to be imparted to the two input signals, and an output form program which determines forms in which the corresponding signals with imparted effects are output. Thus, the data ROM 337 has the function of program storage means, and more particularly, corresponds to input form program storage means, effect program storage means and output form program storage means.

The work RAM 338 realizes the functions of the XRAM, YRAM and external RAM in the previous embodiments. In this case, the XRAM and YRAM are used in the operation for effect impartment, storage of a routine address to control of the inputs/outputs, and temporary stock of input/output data. The external RAM is used as a work area in the signal processing for effect impartment (for example, signal delay, using the external RAM as a delay RAM, etc.). The DSP 336 and the work RAM 338 compose signal processing means 360 as a whole.

The data from the DSP 336 is sent through the bus 339 to D/A converter 340, where the data is subjected to D/A conversion, and the resulting analog signal is sent to the output 341. The output 341 is composed of an amplifier 342 and speaker 304 such that it amplifies the analog signal and causes the speaker 304 to produce a sound based on the analog signal.

When effects are imparted to the two input signals in the present embodiment, programs similar to those used by the preceding embodiments are used to achieve such effect impartment in consideration of reception of an analog signal from the tape recorder 302. Thus, appropriate effects are imparted not only to a signal from the microphone 303, but also to a signal of a voice or the like recorded on the tape recorder 302. Thus, this embodiment produces advantages similar to those produced by the previous embodiments.

E. FIFTH EMBODIMENT

Figure 30:
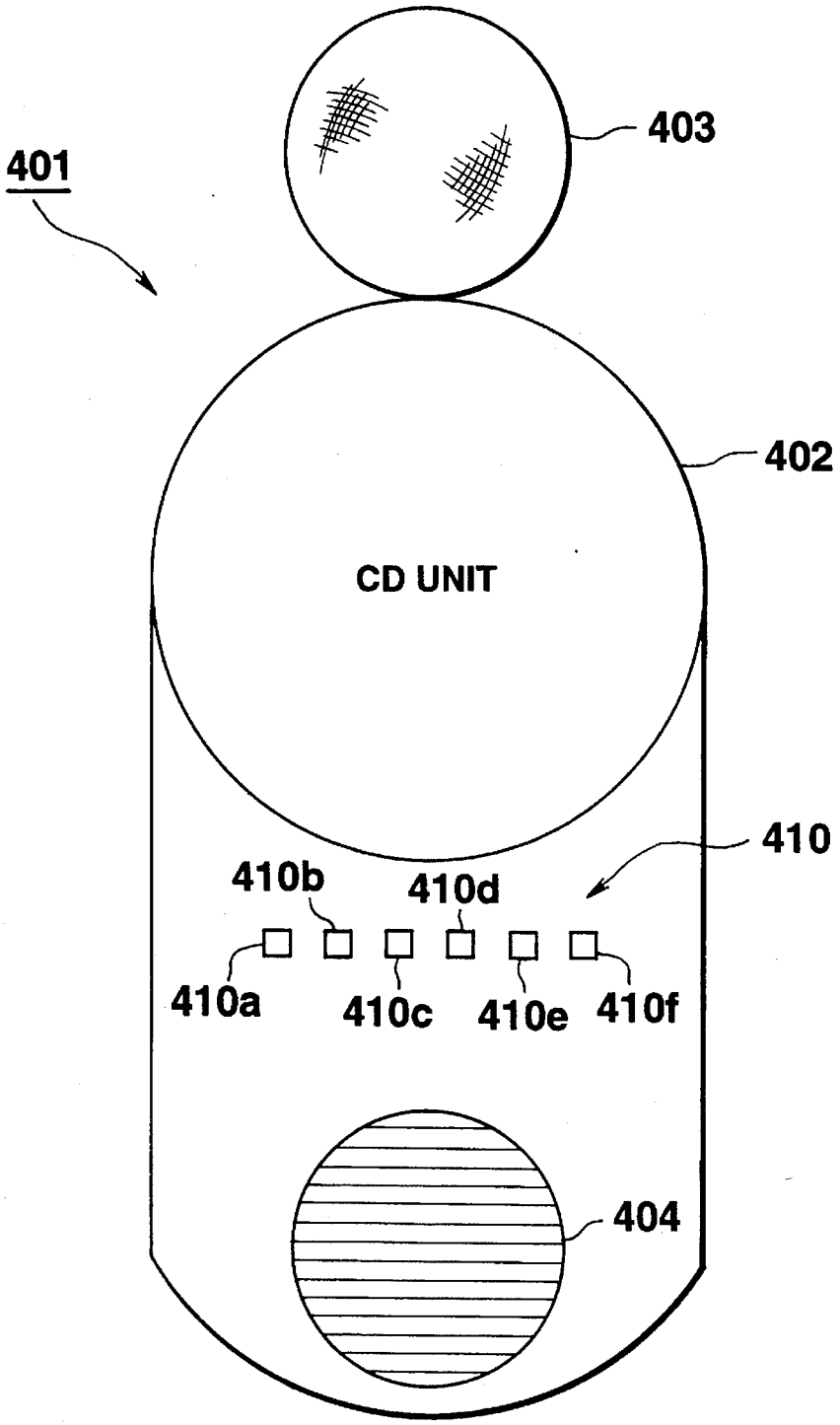
FIG. 30 is a front view of an effect microphone with a CD of a fifth embodiment of the present invention.

The fifth embodiment uses an input signal from a CD (Compact Disk) reproducing device as an example. FIG. 30 shows the appearance of a CDed effect microphone to which the inventive effect imparting apparatus (digital effector) is applied. In FIG. 30, reference numeral 401 denotes a colorful CDed effect microphone device body and for example, the main portion of the body is made of a resin material. The microphone body 401 includes a built-in CD reproducing device 402. The reproducing device may be, for example, of either a regular or a miniaturized size.

The effect microphone device body 401 has a non-directional microphone 403 covered with a soft material such as sponge. The effect microphone device body 401 is composed of a solid having a horizontal substantially elliptical cross section. It has on its front a circular speaker 404, which produces an effect output containing a microphone voice forwardly.

The effect microphone device body 401 has an effect select switch unit (select means) 410 at substantially the center thereof and having 6 keys 410*a*–410*f*, one or two of which can be depressed to select the number of an effect imparted to the input signal (in this embodiment, a microphone signal). The respective keys 410*a*–410*f* of the effect select switch unit 410 may be lighted themselves or display the corresponding numerals "1"–"6" thereon, when depressed.

The effect select switch unit 410 selects a desired one from a plurality of effects as in the previous embodiments and stored beforehand as "EFFECT BANK" in the form of programs. In the fifth embodiment, no effect No. list display is provided, but such display may be disposed at a predetermined position in the effect microphone device body 401 or may be affixed to a manual for this apparatus. The effect microphone device body 401 has an internal power supply (for example, a cell), which normally supplies required operating power to the elements concerned. Alternatively, it may have an external power supply terminal thereon.

The effect microphone device body 401 is provided with various operation switches, for example, including a power supply switch, a switch for starting/stopping a CD 402, a rapid feed switch, a volume for adjusting the volume of the speaker 404, etc., although not shown.

Figure 31:
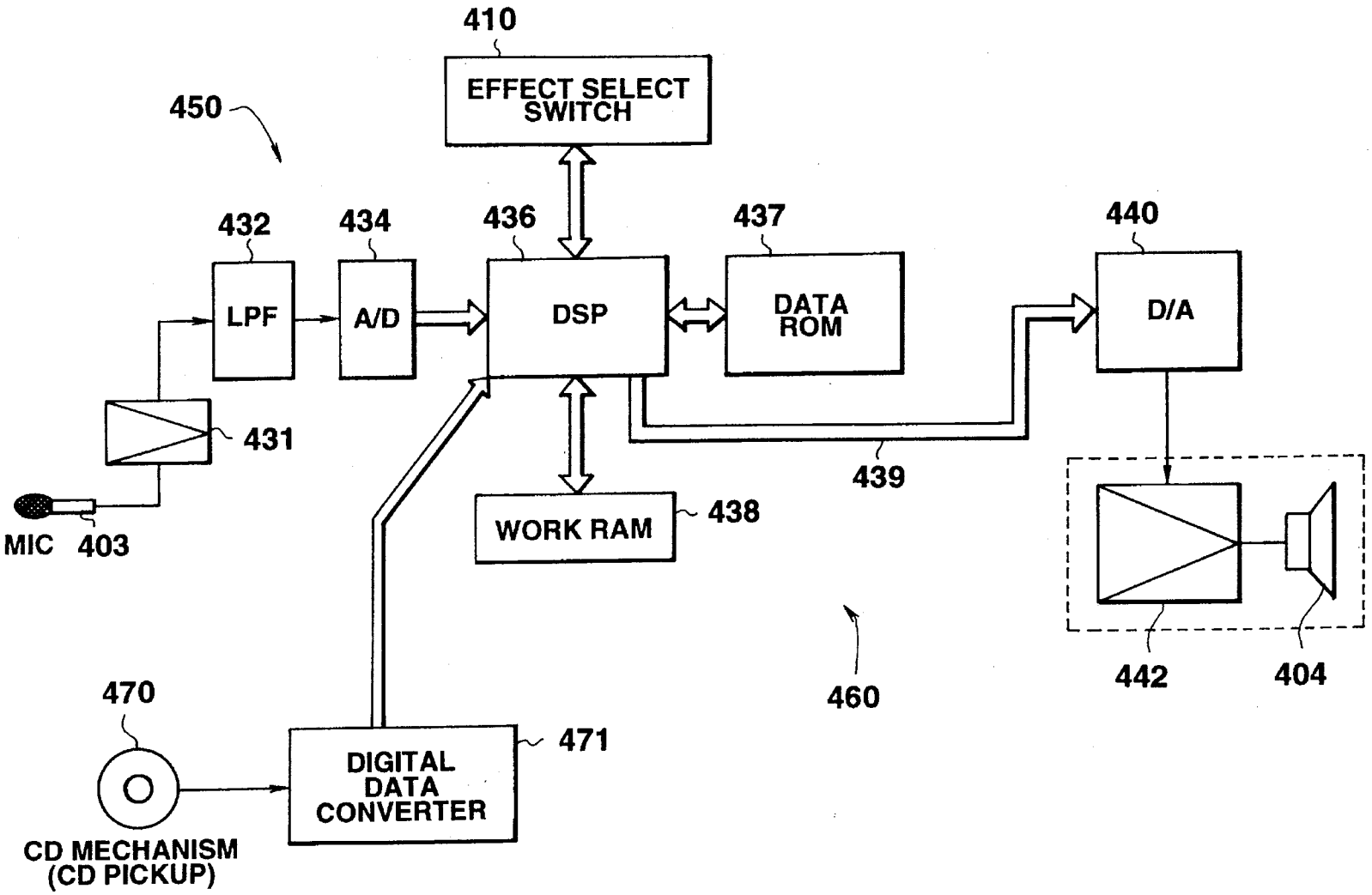
FIG. 31 is a block diagram indicative of an effect imparting apparatus of the fifth embodiment.

FIG. 31 is a block diagram of an effect imparting apparatus provided to the CDed effect microphone device body 401. In FIG. 31, the effect imparting apparatus is provided with an effect select switch unit 410; an amplifier 431; a low pass filter 432; an analog-to-digital converter 434; a DSP 436; a data ROM 437; a work RAM 438; a bus 439; a digital-to-analog converter 440; and an output unit 441.

The effect select switch unit 410 designates an effect number by depression of a key corresponding to a desired effect from among a plurality of predetermined effects to produce and send a signal from the effect select switch unit 410 to the DSP 436.

The analog signal from the microphone 303 is amplified by the amplifier 431 and the resulting signal is sent through a low pass filter 432 to the analog-to-digital converter 434 where it is converted to a digital signal, which is then sent to the DSP 436. The analog signal from the mechanism (particularly, a CD pickup) 470 of the CD unit 402 is converted by the digital data converter 471 to digital data, which is then sent to the DSP 436.

The microphone 403, CD unit 402, amplifier 431, low pass filter 432, and analog-to-digital converter 434, and digital data converter 471 compose input means 450 as a whole. The input means 450 receives analog signals from the microphone 403 and CD unit 402.

The DSP 436 realizes the functions of the control unit and processor of the previous embodiments. It reads the effect number designated by the effect select switch unit 410, reads the corresponding header data out of the data ROM 437, sends/receives data to/from the A/D converter 434, digital data converter 471, and D/A converter 440, and controls addresses and data in the work RAM 338. The data ROM 437 stores header data and parameters corresponding to effects and forms of effect impartment.

More particularly, the data ROM beforehand stores input form programs corresponding to the forms of impartment of effects to the respective two input signals, effect programs corresponding to the respective effects to be imparted to the two input signals, and an output form program which determines a form in which the signal with imparted effects is output.

The work RAM 438 realizes the functions of the XRAM, YRAM and external RAM in the previous embodiments. In this case, the XRAM and YRAM are used in the operation for effect impartment, storage of routine addresses to control the inputs/outputs, and temporary stock of input and output data. The external RAM is used as a work area in the signal processing for effect impartment (for example, signal delay, using the external RAM used as a delay RAM, etc.). The DSP 436 and the work RAM 438 compose signal processing means 460 as a whole.

The data from the DSP 436 is sent through the bus 439 to D/A converter 440, where the data is subjected to D/A conversion and the resulting analog signal is sent to the output 441. The output 441 is composed of an amplifier 442 and a speaker 404 such that it amplifies the analog signal and causes the speaker 404 to produce a sound based on the analog signal.

When effects are imparted to the two input signals in the present embodiment, programs similar to those used by the preceding embodiments are used to achieve such effect impartment in consideration of reception of an analog signal from the CD unit 402. Thus, an appropriate effect is imparted not only to an input signal from the microphone 403, but to a music data on which is recorded in the CD unit 402 to thereby produce advantages similar to those produced by the preceding embodiments.

The CD unit 402 may be not only a reproduction-dedicated unit, but also a CD unit which is, for example, both recordable/reproducible. It may be a laser disk. The input signals are not limited to the above illustrative ones, but may be other signals such as signals generated by a microcomputer.

In the fourth and fifth embodiments, means such as liquid crystal display may be provided for displaying the number of an effect to be imparted to the input signal.

What is claimed is:

1. An effect imparting apparatus comprising:

a program storage unit for storing a plurality of programs corresponding to a number of effects to be imparted to an input signal which is input to said apparatus;

a selector for externally selecting any one of the programs stored in said program storage unit; and a signal processor for imparting and outputting an effect to the input signal on the basis of the program selected by said selector, and for outputting the resulting signal;

said program storage unit comprising:

an input form program storage unit for storing a plurality of programs each of which determines a form of imparting an effect to the input signal;

an effect program storage unit for storing a plurality of programs each corresponding to an effect to be imparted to a respective one of the input signals; and an output form program storage unit for storing a plurality of output form programs which determine a form in which the signal with an imparted effect should be output.

2. An effect imparting apparatus according to claim 1, further comprising a display panel provided on an outer surface of said apparatus for displaying thereon the contents of the programs stored in said program storage unit.

3. An effect imparting apparatus according to claim 1, wherein said selector comprises a display unit for displaying data on the program selected from said program storage unit.

4. An effect imparting apparatus according to claim 1, wherein said input signal comprises one of a first and a second input signal.

5. An effect imparting apparatus according to claim 1, wherein said selector includes a ten-key unit.

6. An effect imparting apparatus according to claim 1, wherein:

said input form program storage unit selects a form in which an effect corresponding to a first effect program is imparted to any of a first input signal alone, a second input signal alone and a mixture of the first and second input signals; and said input form program storage unit stores a program for selecting at least one of the first input signal, the second input signal, and a signal to which the first effect is imparted, to impart a second effect corresponding to a second effect program to one of the selected input signal and a mixture of the at least one signal selected by the program stored in said input form program storage unit.

7. An effect imparting apparatus according to claim 1, wherein said output form program storage unit stores a program for selecting at least two of a signal with a first imparted effect, a signal with a second imparted effect, and a first and a second input signal which is input from an input means, so as to mix and output the selected at least two signals.

8. An effect imparting apparatus according to claim 1, wherein said input form program storage unit, said effect program storage unit, and said output form program storage unit share a common storage unit capable of reading a program.

9. An effect imparting apparatus comprising:

an input form program storage unit for storing a plurality of programs each corresponding to a form of an effect to be imparted to a respective one of a plurality of input signals which are input to said apparatus;

an effect program storage unit for storing a plurality of programs each corresponding to one of a plurality of effects which are to be imparted to the plurality of input signals;

an output form program storage unit for storing a plurality of output form programs for selecting signals to be output from among signals with imparted effects;

a selector for externally selecting a desired input form program, effect program and output program from said input form program storage unit, effect program storage unit, and output form program storage unit, respectively; and a signal processor for imparting an effect to the plurality of input signals on the basis of said input form program, effect program and output form program selected by said selector.

10. An effect imparting apparatus according to claim 9, wherein said plurality of input signals comprise a first and a second input signal.

11. An effect imparting apparatus according to claim herein said selector comprises a ten-key unit.

12. An effect imparting apparatus according to claim 9, wherein:

said input form program storage unit selects a form in which an effect corresponding to a first effect program is imparted to any one of a first input signal alone, a second signal alone and a mixture of the first and second input signals; and said input form program storage unit stores a program for selecting at least one of the first input signal, the second input signal, and a signal to which the first effect is imparted to impart a second effect corresponding to a second effect program to one of the selected input signal and a mixture of the at least one signal selected by the program stored in said input form program storage unit.

13. An effect imparting apparatus according to claim 9, wherein said output form program storage unit stores a program for selecting at least two of a signal with a first imparted effect, a signal with a second imparted effect, and a first and a second input signal which is input from an input means, so as to mix and output the selected at least two signals.

14. An effect imparting apparatus according to claim 9, wherein said input form program storage unit, said effect program storage unit, and said output form program storage unit comprise a common storage unit capable of reading a program.

15. An effect imparting apparatus comprising:

a program storage unit for storing a plurality of programs corresponding to a number of effects to be imparted to an input signal which is input to said apparatus;

a selector for selecting a desired one of the programs stored in said program storage unit;

a signal processor for imparting and outputting an effect to the input signal on the basis of the program selected by said selector, and for outputting the resulting signal;

a controller provided on an outer surface of said apparatus for externally controlling a selection by said selector; and a display panel provided on the outer surface of said apparatus and displaying a program stored in said program storage unit;

said program storage unit comprising:

an input form program storage unit for storing a plurality of programs each of which determines a form of imparting an effect to the input signal;

an effect program storage unit for storing a plurality of programs each corresponding to an effect to be imparted to the input signals; and an output form program storage unit for storing a plurality of output form programs which determine a form in which the signal with an imparted effect should be output.

16. An effect imparting apparatus according to claims 15, wherein said input signal comprises one of a first and a second input signal.

17. An effect imparting apparatus according to claim 15, wherein said selector includes a ten-key unit.

18. An effect imparting apparatus according to claim 15, wherein:

said input form program storage unit selects a form in which an effect corresponding to a first effect program is imparted to any of a first input signal alone, a second input signal alone and a mixture of the first and second input signals; and said input form program storage unit stores a program for selecting at least one of the first input signal, the second input signal, and a signal to which the first effect is imparted, to impart a second effect corresponding to a second effect program to one of the selected input signal and a mixture of the at least one signal selected by the program stored in said input form program storage unit.

19. An effect imparting apparatus according to claim 15, wherein said output form program storage unit stores a program for selecting at least two of a signal with a first imparted effect, a signal with a second imparted effect, and a first and a second input signal which is input from an input means, so as to mix and output the selected at least two signals.

20. An effect imparting apparatus according to claim 15, wherein said input form program storage unit, said effect program storage unit, and said output form program storage unit share a common storage unit capable of reading a program.

* * * * *

UNITED STATES PATENT AND TRADEMARK OFFICE

CERTIFICATE OF CORRECTION

PATENT NO. : 5,463,691
DATED : October 31, 1995
INVENTOR(S) : NAKAE et al.

It is certified that error appears in the above-indentified patent and that said Letters Patent is hereby corrected as shown below:

On the Title page, Item [75] Inventors:

change "Tetsiochi" to --Tetsuichi--.

Colunm 20, line 17 (claim 1), delete "a respective one of"; same line, change "signals" to --signal--.

Column 21, line 18 (claim 11), after "claim" insert --9--;

line 19 (claim 11) change "herein" to --wherein--.

Signed and Sealed this
Twenty-eighth Day of January, 1997

*Attest:*

Bruce Lehman

BRUCE LEHMAN

*Attesting Officer*

*Commissioner of Patents and Trademarks*